US008430254B2

(12) United States Patent
Kunis

(10) Patent No.: US 8,430,254 B2
(45) Date of Patent: Apr. 30, 2013

(54) PORTABLE MODULAR CLOSET INSERT AND METHOD OF USING THE SAME

(76) Inventor: Steven C. Kunis, New City, NY (US)

( * ) Notice: Subject to any disclaimer, the term of this patent is extended or adjusted under 35 U.S.C. 154(b) by 883 days.

(21) Appl. No.: 12/408,303

(22) Filed: Mar. 20, 2009

(65) Prior Publication Data

US 2010/0237031 A1 Sep. 23, 2010

(51) Int. Cl.
*A47B 43/00* (2006.01)
*A47B 47/00* (2006.01)
*A47B 46/00* (2006.01)

(52) U.S. Cl.
USPC ..... 211/189; 312/258; 312/262; 312/257.1; 312/263; 312/249.8

(58) Field of Classification Search ..... 211/86.01, 211/189, 175, 208, 85.3, 103, 134; 312/257.1, 312/263, 265.5, 108, 111, 249.8, 258, 262
See application file for complete search history.

(56) References Cited

U.S. PATENT DOCUMENTS

| | | | | | |
|---|---|---|---|---|---|
| 67,950 | A * | 8/1867 | Brown | 312/257.1 |
| 419,920 | A * | 1/1890 | Campbell | 217/12 R |
| 1,268,509 | A * | 6/1918 | Stone | 312/263 |
| 2,565,000 | A * | 8/1951 | Schultz | 126/9 R |
| 2,579,897 | A * | 12/1951 | Blechman | 217/65 |
| 2,626,198 | A * | 1/1953 | Vanderveld | 312/108 |
| 3,675,955 | A * | 7/1972 | Hajduk | 217/65 |
| 4,125,304 | A * | 11/1978 | Ebert | 312/257.1 |
| 5,249,857 | A * | 10/1993 | Suzuki | 312/263 |
| 6,099,095 | A * | 8/2000 | Irace | 312/257.1 |
| 6,123,208 | A * | 9/2000 | Haenszel | 211/175 |
| 6,135,583 | A * | 10/2000 | Simon et al. | 312/257.1 |
| 6,409,293 | B1 * | 6/2002 | Chang | 312/257.1 |
| 6,672,690 | B1 * | 1/2004 | Williams | 312/245 |
| 6,675,978 | B2 * | 1/2004 | Shea | 211/59.1 |
| 6,681,941 | B1 * | 1/2004 | Johnson | 211/86.01 |
| 6,962,476 | B2 * | 11/2005 | Trpkovski | 414/745.1 |
| 7,264,321 | B1 * | 9/2007 | Bueley et al. | 312/265.5 |
| 8,042,890 | B2 * | 10/2011 | Collins et al. | 312/263 |
| 2002/0190614 | A1 * | 12/2002 | Reuter | 312/257.1 |
| 2003/0230957 | A1 * | 12/2003 | Doerfler et al. | 312/257.1 |
| 2004/0090156 | A1 * | 5/2004 | Kunanantakul | 312/257.1 |
| 2005/0168115 | A1 * | 8/2005 | Moon et al. | 312/257.1 |
| 2005/0206280 | A1 * | 9/2005 | Mehmen et al. | 312/257.1 |
| 2005/0263473 | A1 * | 12/2005 | TenBrink | 211/189 |
| 2006/0108899 | A1 * | 5/2006 | Jin | 312/257.1 |
| 2006/0250052 | A1 * | 11/2006 | Davis et al. | 312/107 |
| 2011/0025181 | A1 * | 2/2011 | Vinke et al. | 312/257.1 |

* cited by examiner

*Primary Examiner* — Jonathan Liu
*Assistant Examiner* — Devin Barnett
(74) *Attorney, Agent, or Firm* — Cozen O'Connor

(57) ABSTRACT

A closet insert structured to fit in a closet enclosure in its entirety—includes at least one insert module including back, top and floor panels, and two end panels. Mounting structure is provided on at least one of the panels to which a coupling device is mountable for coupling another insert module to the at least one insert module.

14 Claims, 34 Drawing Sheets

PORTABLE MODULAR CLOSET INSERT AND METHOD OF USING THE SAME

FIELD OF THE INVENTION

This invention relates generally to the field of portable storage containers and, more particularly, to methods and apparatus for storing clothing and other personal items in a closet.

BACKGROUND OF THE INVENTION

The use of closets to store personal items in homes and apartments has always had the inherent limitation that the space available in a closet is finite and restricted. This limitation is often a problem in the case of storing clothing in closets. For example, those who reside in regions that experience warm summers and cold winters generally have at least two sets of garments, heavier garments for use during the wintertime and lighter garments for use in warmer months. However, the limited space provided by closets in a home or apartment is often insufficient to accommodate the entire wardrobe owned by a person and/or his family in a neat and efficient manner. This is especially problematic in the case of apartments which tend to have fewer and smaller closets.

One solution to the problem is for the resident to purchase an article of furniture, such as a wardrobe or armoire, in which garments that cannot easily fit into the closet can be hung or otherwise placed. However, while this may free up needed space in the closet, the additional piece of furniture itself takes up space in the room in which it is kept, which in the case of a small apartment or room may be undesirable or impossible.

For these reasons, it is not uncommon for residents of apartments and homes to temporarily store their personal items at off-site locations remote from their residence and then retrieve the remotely stored items when those items are desired for use. Specifically, in the case of seasonal clothing and other related items, summer clothing may be stored at a remote location during winter months while winter clothing may be stored at a remote location during warmer months of the year.

Traditionally, a person will pack his or her seasonal garments that are to be temporarily stored in a box, carry the packed box to his or her car, and then transport the packed box to a storage center, repeating the process when necessary. Obviously, this is a time consuming process requiring removing garments from hangers, folding the garments, packing the box, lifting the box and driving the filled box to the storage location. When the garments are needed again, the packed box is retrieved, transported back to the residence, and unpacked. The garments must be refolded or re-hung and cleaned.

Systems are known wherein portable closet-type storage units are delivered to a person's residence by a storage company. In the summer, the resident packs the storage unit by hanging his or her winter clothing on a hanger rod provided in the storage unit and placing folded garments on shelves contained in the storage unit. The storage unit has doors or other closures which are closed or fitted onto the unit and the packed storage unit is picked up by the storage company and transported to a remote off-site storage location where it is stored until the winter clothing is needed (and the summer clothing in the apartment closet is not). At that time the packed storage unit is delivered by the storage company to the residence and the summer and winter clothes are exchanged. Generally, the winter clothes are unpacked from the storage unit and temporarily laid out on the floor or bed near the closet. The summer clothes hanging in the closet are removed from the closet and hung or otherwise placed in the storage unit. The winter clothes are then replaced back into the closet. This is a time consuming process requiring clothing to be refolded or re-hung on their hangers and cleaned. The storage unit, now packed with winter clothes, is transported to the off-site location where it is stored until the return of warm weather.

Another problem often arises in the temporary storage of personal items such as clothing in a closet at a remote location, such as a hotel, college dormitory or the like. Traditionally, a person will pack his or her clothing in a trunk or the like at his or her residence, transport the packed trunk to the remote location, unpack the trunk and hang the clothing in a closet at the remote location. This is time consuming and often results in the clothes becoming wrinkled. Alternatively, the clothing can first be hung in a portable wardrobe at the residence which is then transported to the remote location. The clothes are left in the wardrobe which itself is situated in the living space of the hotel or dormitory room. This is problematic in that the wardrobe takes up valuable living space.

SUMMARY OF THE INVENTION

Accordingly, it is an object of the present invention to provide a new and improved portable storage unit.

Another object of the present invention is to provide a new and improved portable storage unit for temporary storage of personal items, such as clothing normally kept in a closet, at a remote location.

Still another object of the present invention is to provide a new and improved portable storage unit whose use in temporary storage of personal items such as clothing at remote locations does not require packing, boxing, lifting or cleaning.

A further object of the present invention is to provide a new and improved portable storage unit for temporary storage at a remote location of garments normally kept in a closet and for keeping those same garments in the closet when desired, without having to re-hang, refold or clean those garments.

A still further object of the present invention is to provide a new and improved portable storage unit for efficiently storing garments in a closet at a residence, hotel room, dormitory room or the like, without taking up any living space.

Yet another object of the present invention is to provide a new and improved portable storage unit which effectively substantially doubles the storage area of a closet.

Another object of the present invention is to provide a new and improved method for using a portable storage unit for the temporary storage of clothing at a remote location.

Still another object of the present invention is to provide a new and improved method for situating a portable storage unit within a closet enclosure in its entirety.

Still another object of the present invention is to provide a new and improved storage unit which is useful in new construction eliminating the need to install closet hardware and shelving in closet enclosures of new buildouts.

Briefly, in accordance with the present invention, these and other objects are attained by providing a portable storage unit that it is structured and arranged to be removably inserted into and to fit in its entirety within the confines of a conventional closet of the type found in residential homes and apartments, hotels, dormitory rooms and the like. As such, the portable storage unit will be referred to herein as a "closet insert". The interior of the closet insert is fitted with closet organizers such as hanger bar(s), shelves, drawers and the like so that when the closet insert is situated within the close space, it in effect becomes the closet itself.

The closet insert is designed to utilize the space within the closet enclosure to the maximum extent feasible while enabling the closet insert to be easily inserted into and removed from the closet enclosure and without the need to remove clothing or other personal items. To this end the closet insert has a modular construction and comprises at least one insert module, each insert module including a back panel and top and floor panels extending from the back panel. Each insert module has mounting structure provided on at least one of the panels to which a coupling device is mountable for coupling another insert module to the at least one insert module. The closet insert also includes left and right end panels extending from at least one back panel of the at least one insert module. The closet insert can comprise a single insert module in which case the left and right end panels extend from the back panel of the single insert module, two (left and right) insert modules in which case the left and right end panels extend from the back panels of the left and right insert modules and coupling devices are mounted on the mounting structures on the left and right insert modules for coupling the left and right modules to each other, or more than two (left, right and intermediate) insert modules wherein the left and right end panels extend from the back panels of the left and right insert modules respectively and coupling devices are mounted on the mounting structures of the insert modules for coupling the left, right and intermediate insert modules to each other. Closet organizer hardware is affixed to the inner surface of at least one of the panels of each insert module. The hardware is preferably mounted from both end panels and/or the back panel, depending upon which closet organizational system is used. Wheels or casters are provided on the bottom of a floor panel of at least one of the insert modules. Door panels are provided, each of which is structured and arranged to connect to the top, side (where applicable) and floor panels of a respective insert module.

According to the invention, in use, one or more insert modules are selected based upon the length of the closet enclosure into which the closet insert is to be inserted, the length of each closet module and the size of the closet entrance, i.e. the length of the closet insert should utilize the space within the closet enclosure to the maximum extent feasible, while the length of each insert module should be sufficiently short to enable the closet insert to be easily inserted into and removed from the closet enclosure through the closet entrance. End panels are connected to the left and right edge regions of the back panels of the left and right insert modules, or in the case where only a single module is used, to the left and right edge regions of the back panel of the single module. In the case where the closet insert comprises more than one module and the closet door opening does not allow for insertion of the closet insert as one combined unit, the insert module(s) are separately inserted into the closet enclosure and are coupled to each other in the enclosure to form the closet insert. At this point clothing may be hung or otherwise situated in the closet insert. When it is desired to remove the closet insert from the closet enclosure, in the case where the insert comprises more than one module and where the closet door opening does not allow for removal of the closet insert as one combined unit, the modules are decoupled while situated in the closet enclosure. Since each module is provided with its own closet organizer hardware, it is not necessary to remove the clothing from the insert modules before decoupling. Each module, with the clothing contained therein, is removed from the closet enclosure. In the case where the closet insert is to be transported to a remote location, the insert modules are again coupled to each other whereupon the door panels are connected to respective modules to close the closet insert.

An advantageous application of closet inserts in accordance with the invention is in connection with the storage of seasonal clothing at a location remote from the closet during off-season months and the return of such clothing to the closet when the season changes. The use of the closet inserts enables the removal of such clothing from a closet, transport to a storage location where the clothing is stored until needed, and then transport back to the residence where it is returned to the closet, all without the need for unhanging, re-hanging, folding or cleaning the clothing. Another advantageous use of a closet insert in accordance with the invention is the transport of clothing to remote locations such as hotel and dormitory rooms where the closet inserts can be situated in their entirety in a closet enclosure.

BRIEF DESCRIPTION OF THE DRAWINGS

A more complete appreciation of the present invention and many of the attendant advantages thereof will be readily understood by reference to the following detailed description when considered in conjunction with the accompanying drawings in which.

DETAILED DESCRIPTION OF THE PREFERRED EMBODIMENT

Figure 1:
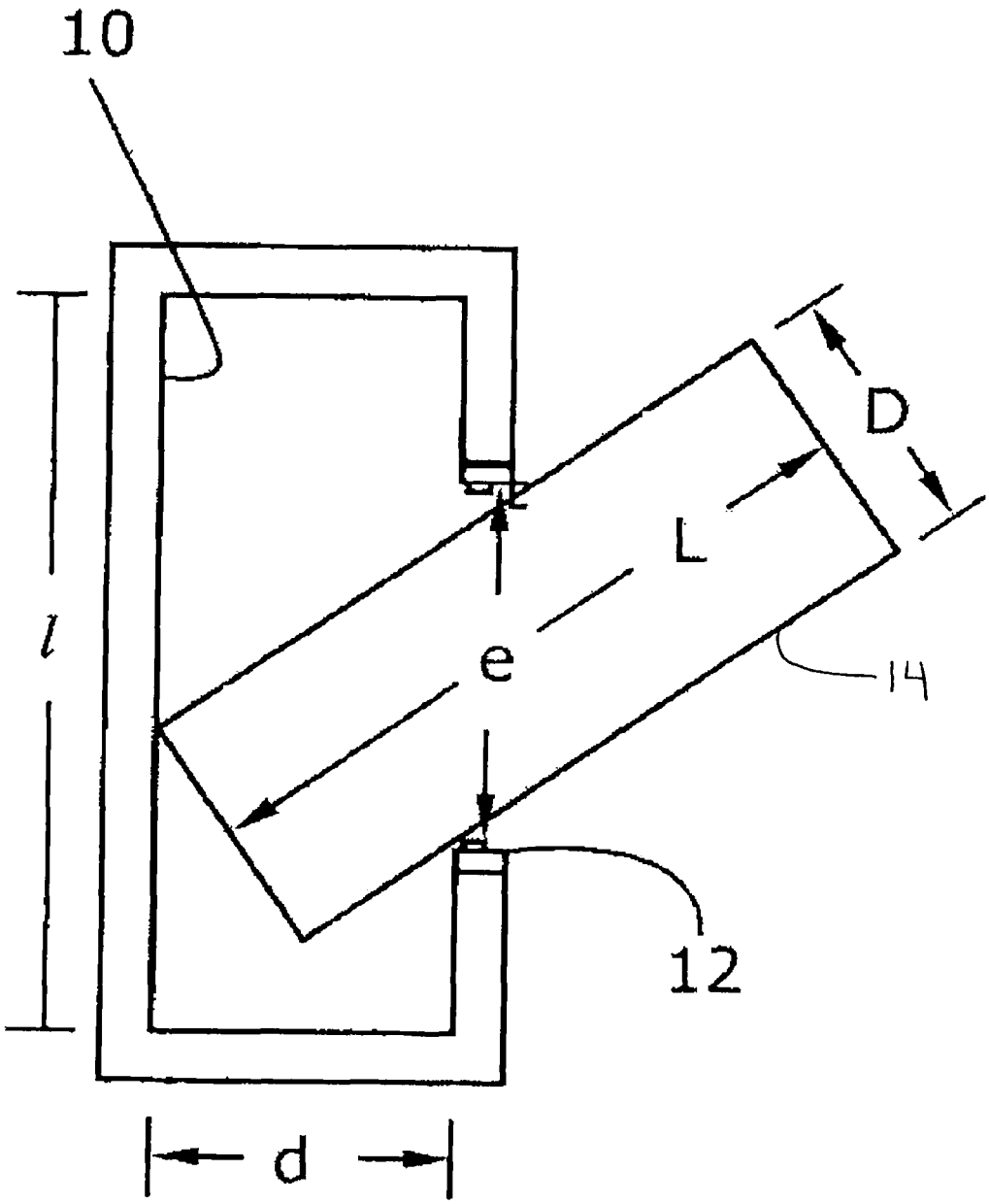
Fig. 1 (Prior Art)
FIG. 1 is a schematic illustration showing a closet enclosure and a prior art portable storage unit in an attempt to insert the storage unit into the closet enclosure.

Referring now the drawings wherein like reference characters designate identical or corresponding parts throughout the several views, FIG. 1 schematically illustrates a closet enclosure 10 having a length l and depth d including an entrance opening 12 having a length e and a portable storage unit 14 constructed according to the prior art. All shelving, drawers and other closet hardware, such as hanger bars, tie racks and the like, have been removed from enclosure 10. The storage unit 14 has a unitary construction with a length L and depth D which are somewhat smaller than the length l and depth d of the closet enclosure 10. For example a conventional closet enclosure may have a length l of about 5 feet, a depth d of about 2 feet, and an entrance opening 12 having a length e of about 30 inches while the portable storage unit 14 may comprise a conventional portable closet having a length L of about 4 feet 8 inches and a depth D of about 21 inches. It is seen from FIG. 1 that, for this example, a conventional portable storage unit which would efficiently occupy space of a conventional closet enclosure will not fit in the closet enclosure due to the limiting dimension of the entrance opening 12.

Figure 2A:
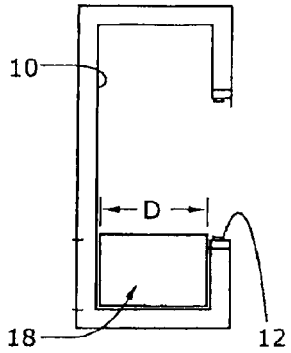
FIGS. 2A-2C are schematic illustrations showing a closet enclosure and a modular closet insert according to the present invention being inserted into the closet enclosure by a process in accordance with the invention.
Figure 2B:
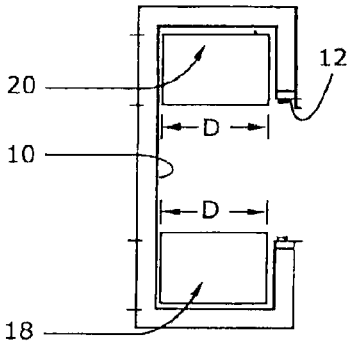
Figure 2C:
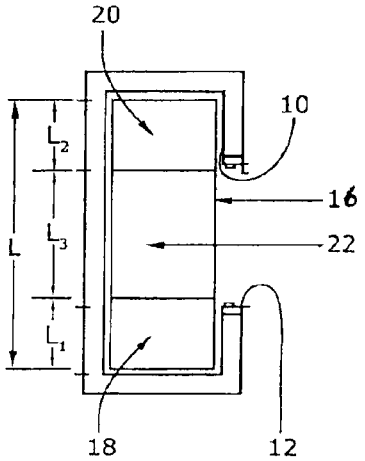

Referring now to FIGS. 2A-2C, in accordance with the present invention, it is possible to provide a portable storage unit that will utilize the space within the closet enclosure to the maximum extent feasible while enabling the closet insert to be easily inserted into, and removed from, the closet enclosure. To this end, a closet insert 16 (FIG. 2C) has a modular construction comprising, in the illustrated example, three closet insert modules, namely, a left closet insert module 18, a right closet insert module 20 and an intermediate closet insert module 22. In the illustrated example the depth D of each of the modules is the same as the depth D of the conventional portable storage unit 14. On the other hand, while the overall length L of the closet insert 16 is the same as the length L of the conventional portable storage unit 14, the individual lengths L1, L2 and L3 of each of the modules 18, 20, 22 is sufficiently small that the three modules can be easily located within the closet enclosure 10. The left insert module 18 is initially inserted into the closet enclosure 10 and positioned in the left area of the enclosure 10 (FIG. 2A) whereupon the right insert module 20 is inserted into and positioned in the right area of the enclosure 10 (FIG. 2B). The intermediate insert module 22 is then inserted into the enclosure 10 between the left and right modules 18, 20. As described in detail below, each of the closet insert modules include mounting structures to which coupling devices are mounted for coupling the modules to each other. As further described below, closet organizer hardware is preferably provided in each of the insert modules so that upon coupling the modules to each other, clothing can be hung or otherwise situated in the closet insert.

When it is desired to remove the closet insert 16 from the closet enclosure 10, such as in the case where summer clothing has been kept in the closet insert 16 and it is desired to transport the summer clothing to a remote storage facility, the closet insert modules 18, 20, 22 are decoupled from each other while they are still situated in the closet enclosure 10 whereupon each module is moved out of the enclosure 10 in an order reversed from the order in which they were inserted. Since the closet organizer hardware is self-contained within each module, it is not necessary to remove any clothing from the modules prior to decoupling. Once the modules have been removed from the closet enclosure, they are re-coupled to each other and door panels are affixed to each module to close the closet insert, which can then be transported to the remote storage location. Another modular closet insert can then be inserted into the vacated closet enclosure for keeping, for example, winter clothing.

Figure 4:
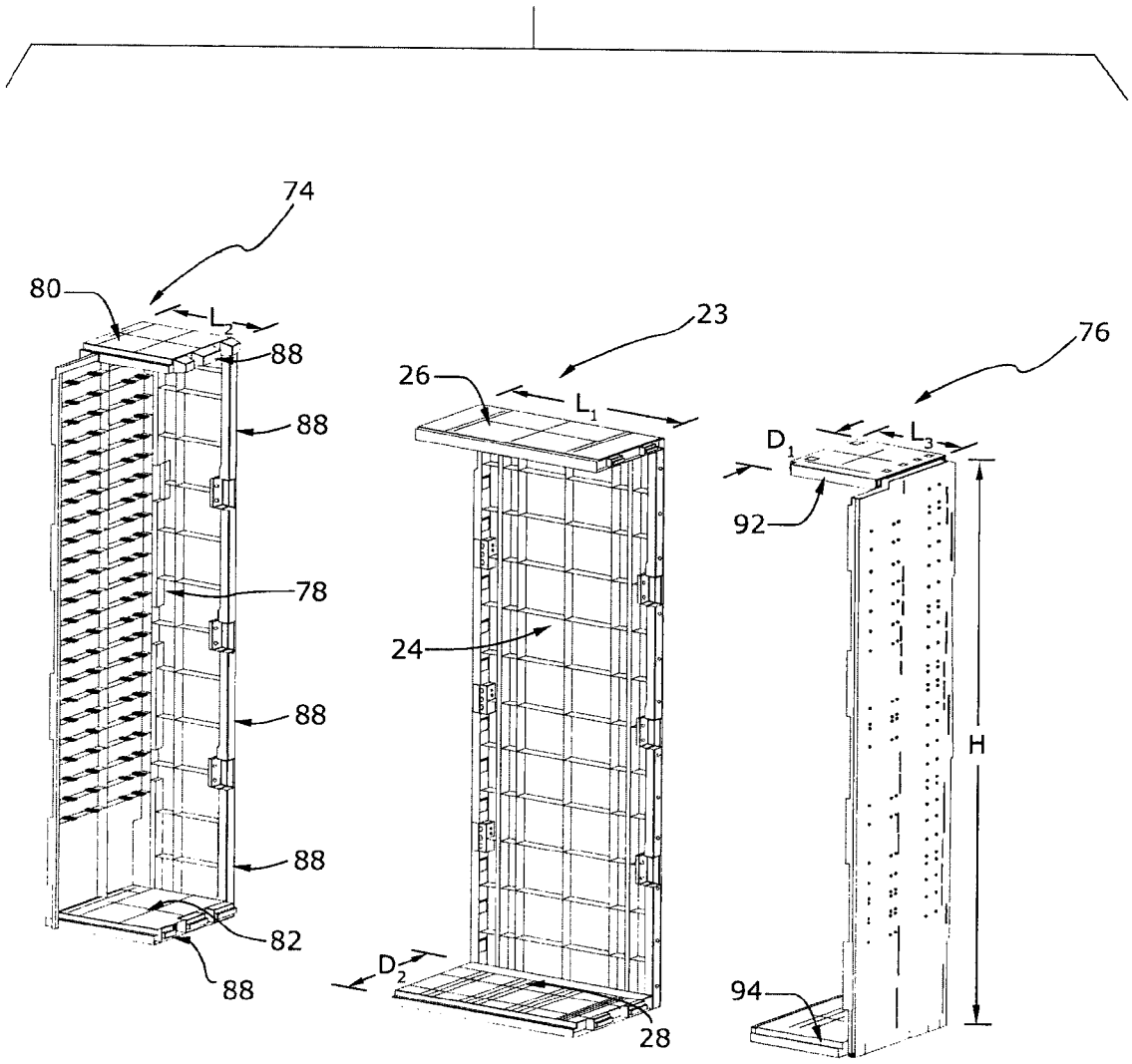
FIG. 4 is a perspective view of the closet insert module shown in FIG. 3 with the three closet insert modules decoupled from each other.

Referring to FIG. 4, the module closet insert system of the illustrated embodiment comprises insert modules having three constructions, namely a first insert module such as module 23, constructed so that it can constitute a closet insert either without being coupled to any other module or by being coupled to another module on its left or right side, or by being coupled to two other modules, one on it's left side and one on its right side, and second and third modules, such as modules 74 and 76, which are constructed to be coupled to the first module on its left and rights sides respectively. In the illustrated embodiment the first module has a nominal length L1 of 2 feet, and the second and third modules have nominal lengths L2 and L3 of 1 foot. In order to insure that a closet insert comprising one or more of the insert modules is able to fit in it's entirety within a conventional closet enclosure, the maximum depth of the closet insert modules should not exceed the depth of a conventional closet enclosure and a depth of about 27 inches is generally acceptable. The particular insert modules utilized for a given application depends on the length of the closet enclosure. It is of course necessary to use one or a combination of modules whose total length is less than the length of the closet enclosure, while it is also desirable to use one or a combination of modules whose total length is close to the length of the closet enclosure. For example, for a closet enclosure having a length of 5 feet, an insert comprising all three of the first, second and third modules, the total length of which, L1+L2+L3, is 4 feet, is indicated. For a closet enclosure having a length of 3.5 feet, a closet insert comprising the first and second insert modules, the total length of which, L1+L2, is 3 feet, is indicated. For a closet enclosure having a length of 2.5 feet, a closet insert comprising the first insert module, the total length of which is 2 feet, is indicated. It is noted that the particular length dimensions of insert modules in accordance with the invention can be other than the example discussed above.

Figure 3:
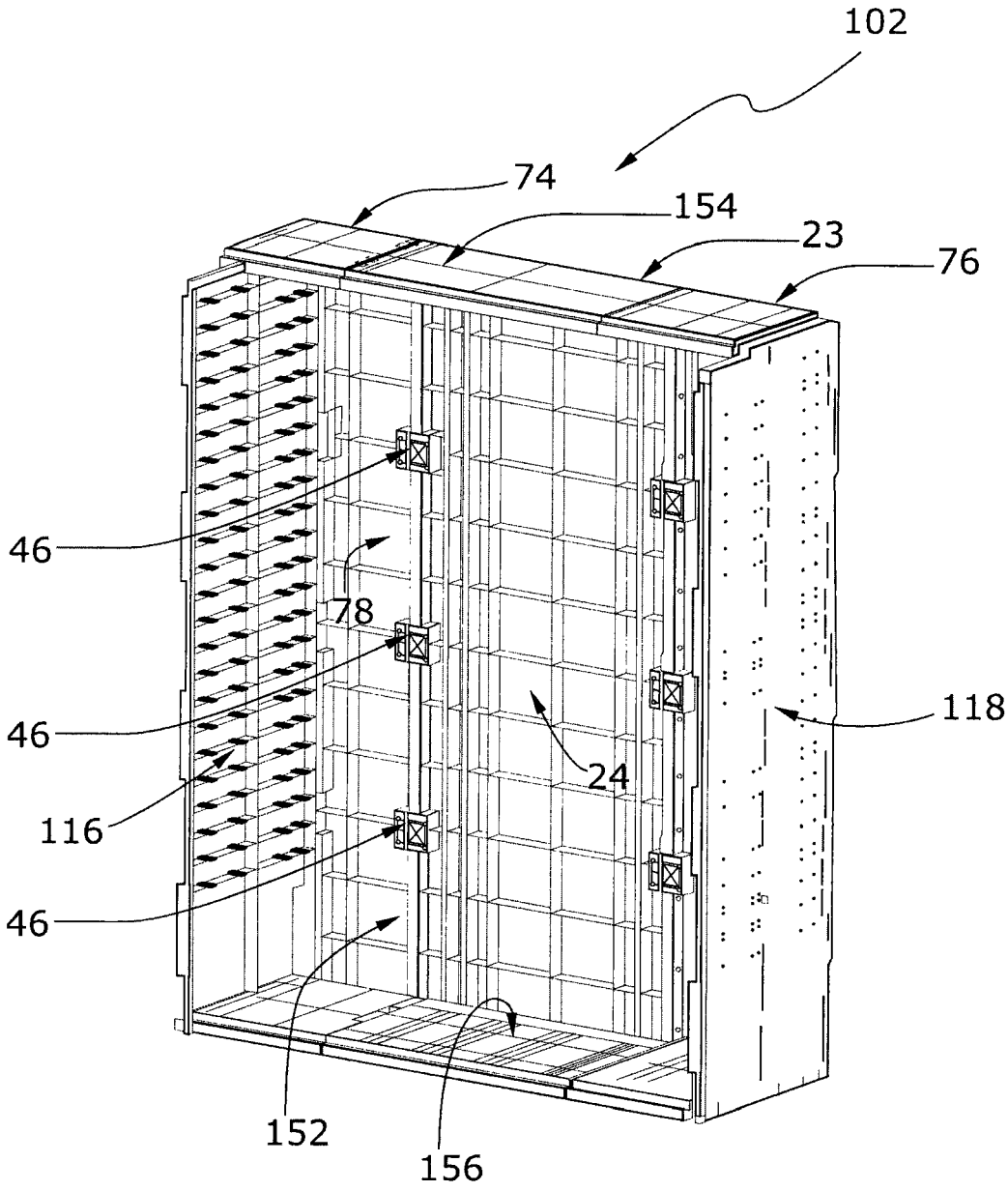
FIG. 3 is a perspective view of a closet insert in accordance with the invention comprising three closet insert modules coupled to each other and a pair of end panels.

Referring now FIGS. 3 and 4, a closet insert 102 in accordance with the invention is illustrated comprising three closet insert modules, namely, a first insert module 23, a second insert module 74 and a third insert module 76. In the illustrated embodiment first insert module 23 constitutes an intermediate module which is situated between the second and third modules 74 and 76, which constitute left and right modules, respectively. Left and right end panels 116 and 118 are attached to the left and right modules 74 and 76 respectively. The details of the construction of closet insert 102 are set forth below. It is understood that while the first module is shown in the embodiment of FIGS. 3 and 4 as constituting an intermediate module, it can also be used as a left or right module in a multi-module insert, or as the only module of a single module insert.

As discussed in greater detail below, each of the three closet insert modules 23, 74 and 76, comprise three panels. Specifically, first module 23 comprises back, top and floor panels 24, 26 and 28, left module 74 comprises back, top and floor panels 78, 80 and 82 and right module 76 comprises back, top and floor panels 90, 92 and 94. All three of back panels extend in a vertical plane and have the same height H, generally in the range of between about 70 inches to 78 inches, all three of the top panels extend in a horizontal plane and have the same depth D1, generally in the range of between about 12 inches to 17 inches and all three of the floor panels extend in a horizontal plane and have the same depth D2. The depth D2 generally should not exceed 27 inches to insure that the modules fit in their entirety within conventional closet enclosures. When the three modules are coupled to each other to form closet insert 102, the three back panels 24, 78 and 90 lie in the same vertical plane to form a back wall 152 of the closet insert 102, the three top panels 26, 80 and 92 lie in the same horizontal plane to form a top wall 154 of the closet insert 102 and the three floor panels 28, 82 and 94 lie in the same horizontal plane to form a floor 156 of the closet insert 102.

Figure 5A:
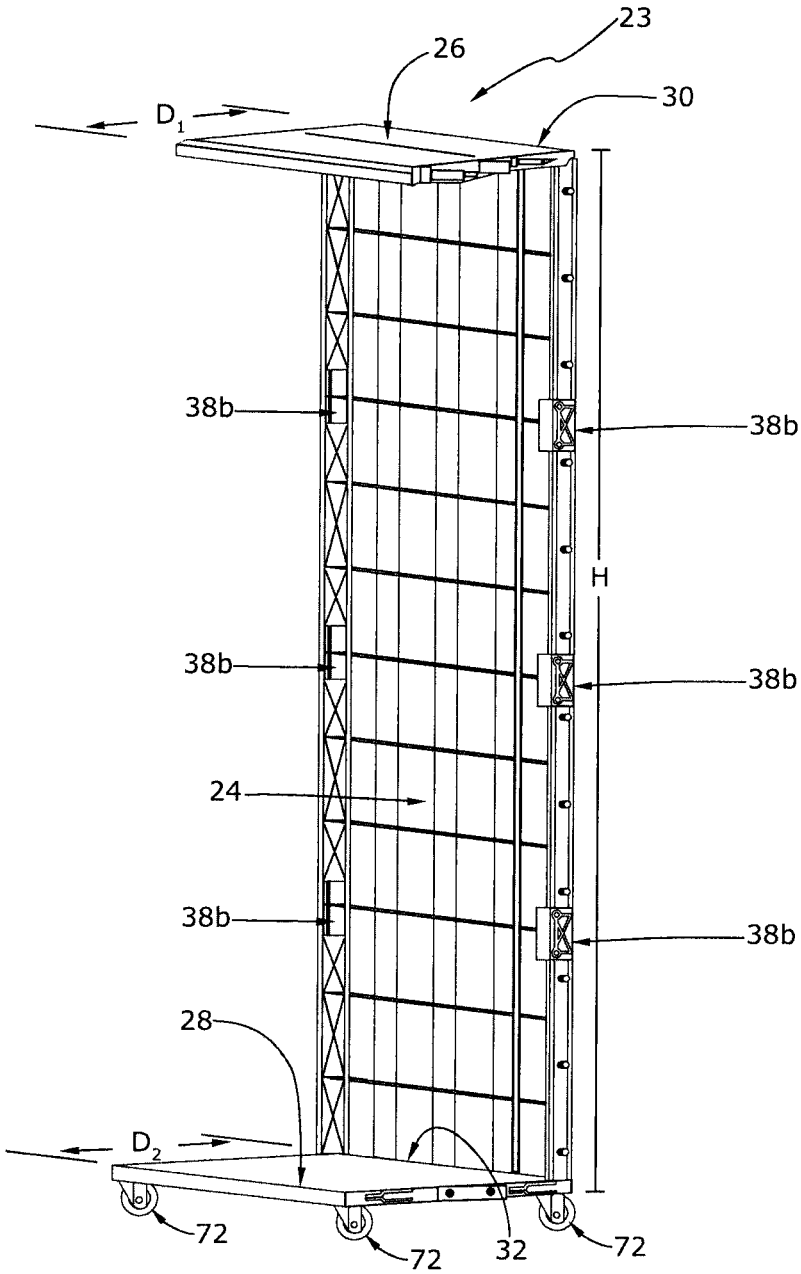
FIGS. 5A and 5B are perspective views of closet insert modules in accordance with the invention which constitute the intermediate and left insert modules respectively of the closet insert shown in FIGS. 3 and 4.

Referring now to FIG. 5A, first closet module 23 includes a substantially rectangular back panel 24 and substantially rectangular top and floor panels 26 and 28 extending from the back panel 24. All of the panels of the first module 23 as well as the panels of the other closet insert modules described below are formed of rigid polypropylene by suitable injection molding processes. Other suitable rigid materials can be used, such as wood, metal and other plastic materials. In some instance the material is treated to impart fire retarding properties for safety reasons. The back panel 24 of first insert module 23 is situated in a substantially vertical plane and includes horizontal upper and lower edge regions 30 and 32 to which the top and floor panels 26 and 28 are connected by threaded fasteners to extend in substantially horizontal planes, perpendicular to the vertical plane in which the back panel 24 is situated. The back panel 24 has a height H, the top panel has a depth D1 and the floor panel has a depth of D2 which is greater than the depth D1.

Figure 11A:
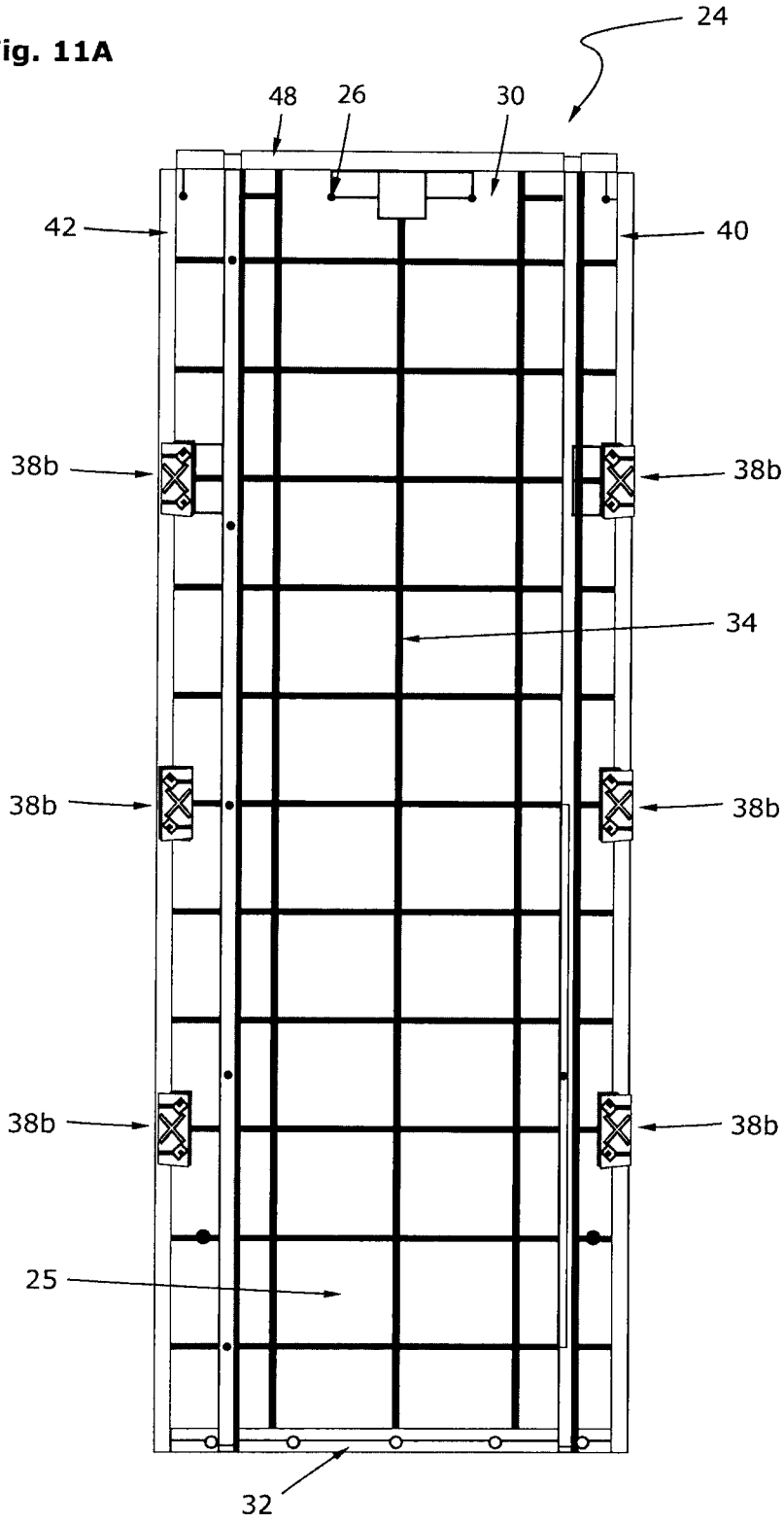
FIGS. 11A and 11B are front and rear elevation views of a back panel of a first closet insert module which constitutes the intermediate module of the closet insert shown in FIGS. 3 and 4.
Figure 11B:
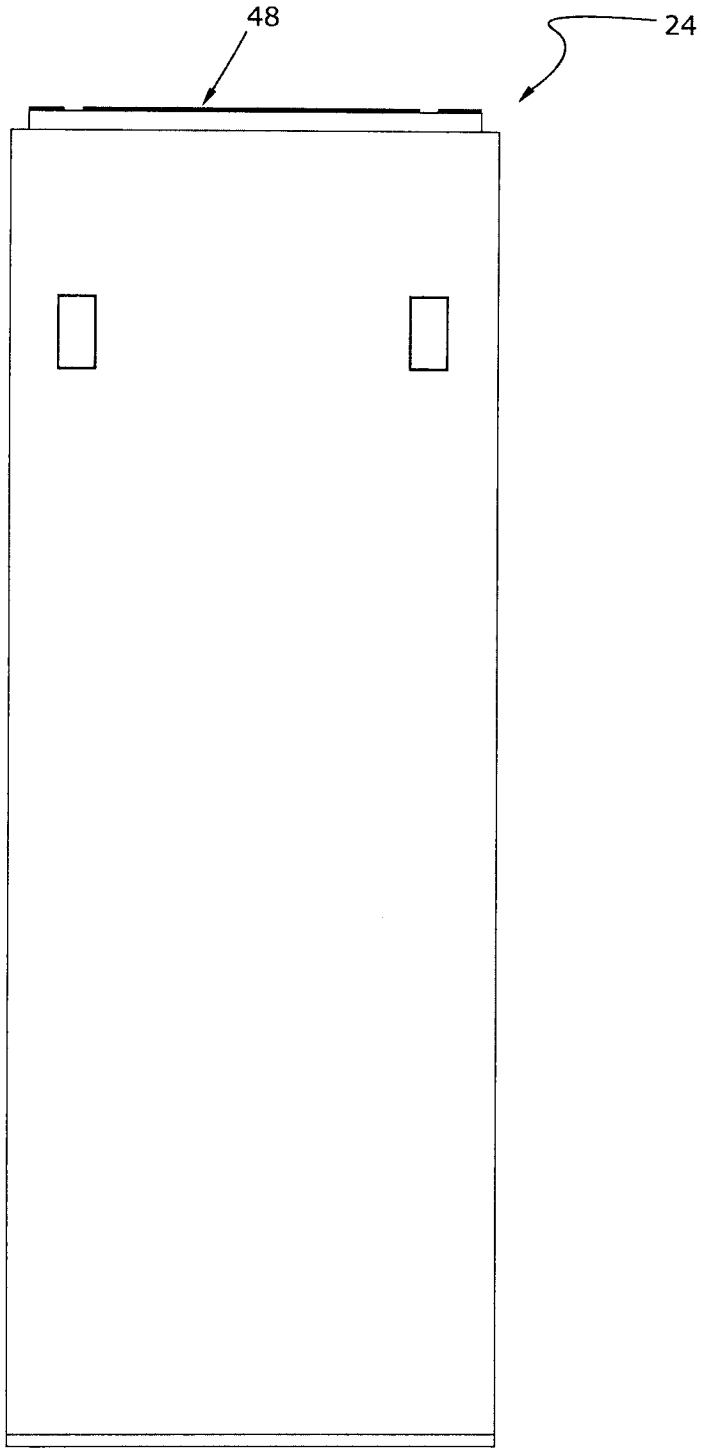

Referring to FIG. 11 in conjunction with FIG. 5A, back panel 24 of first insert module 23 has ribs 34 formed on its forward facing side 25 for strengthening. Openings 26 are formed along the upper and lower edge regions 30 and 32 through which the fasteners for attaching the top and floor panels 26 and 28 pass. Three mounting structures 38*b* are provided along each of the right and left edge regions 40 and 42 of the forward facing side 25 of back panel 24. In the illustrated embodiment, each mounting structure 38*b* comprises a channel formed in the back panel 24 which opens onto the right or left edge of the back panel 24. The channels are structured and arranged to have female members 44 (FIG. 8) of coupling devices 46 mounted on them. Threaded bores are formed in each channel of each mounting structure 38*b* to receive bolts which fixedly mount the female coupling members 44 to each mounting structure 38*b*. A tongue 48 extends upwardly along the edge of upper edge region 30 of back panel 24.

Figure 12A:
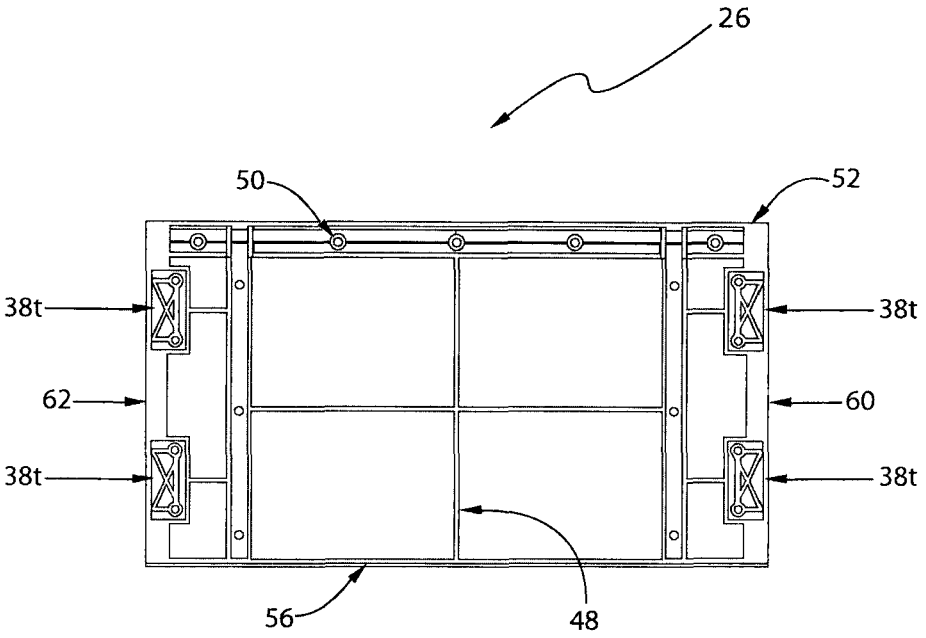
FIGS. 12A and 12B are bottom and top plan views of a top panel of the first closet insert module.
Figure 12B:
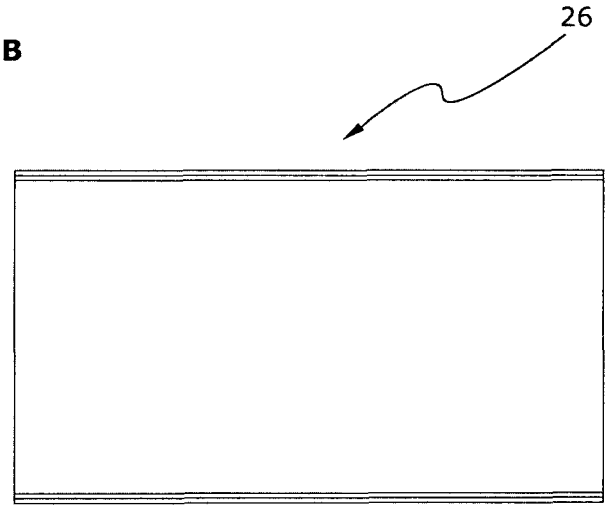
Figure 14A:
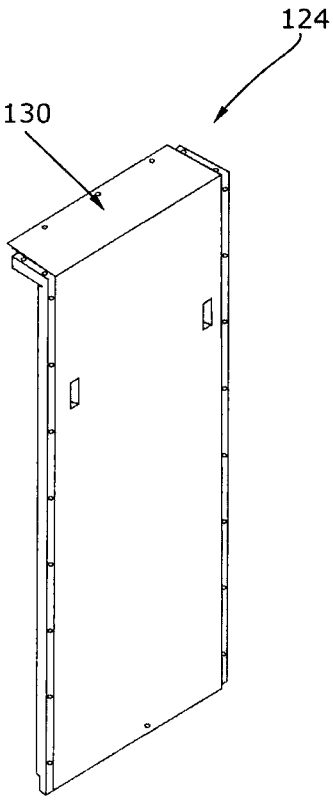
FIG. 14A is a right side perspective view of a door panel for the first closet insert module.
Figure 14B:
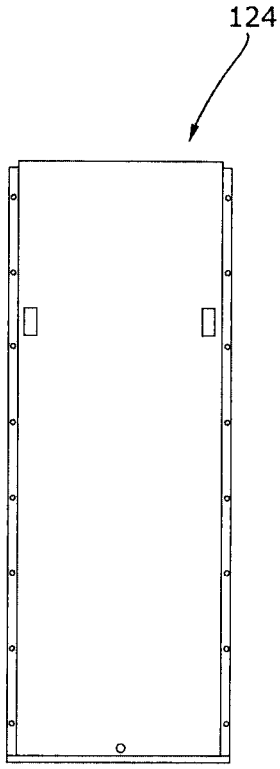
FIG. 14B is a front elevation view of the door panel shown in FIG. 14A.
Figure 14C:
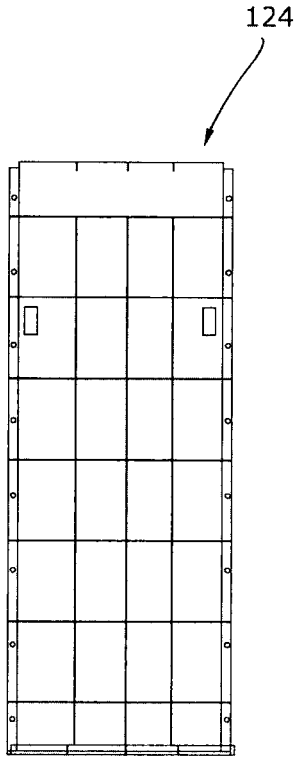
FIG. 14C is a rear elevation view of the door panel shown in FIGS. 14A and 14B.

Referring to FIG. 12 in conjunction with FIG. 5A, top panel 26 of first insert module 23 has strengthening ribs 48 formed on its downward facing surface. Openings 50 are formed through top panel 26 along its forward edge region 52 through which fasteners for fastening a door panel 54 (FIG. 14) to the first closet insert module 23 pass. A groove 56 is formed along the rearward edge region 58 of top panel 26 to receive the tongue 48 of back panel 24 when the top and back panels are fixedly connected to each other. A pair of mounting structures 38*t* are provided along each of the right and left edge regions 60 and 62 of top panel 26 and open onto the right and left edges of the top panel 26. The mounting structures 38*t* are identical to mounting structures 38*b* and are structured and arranged to have female members 44 of coupling devices 46 mounted thereon.

Figure 13A:
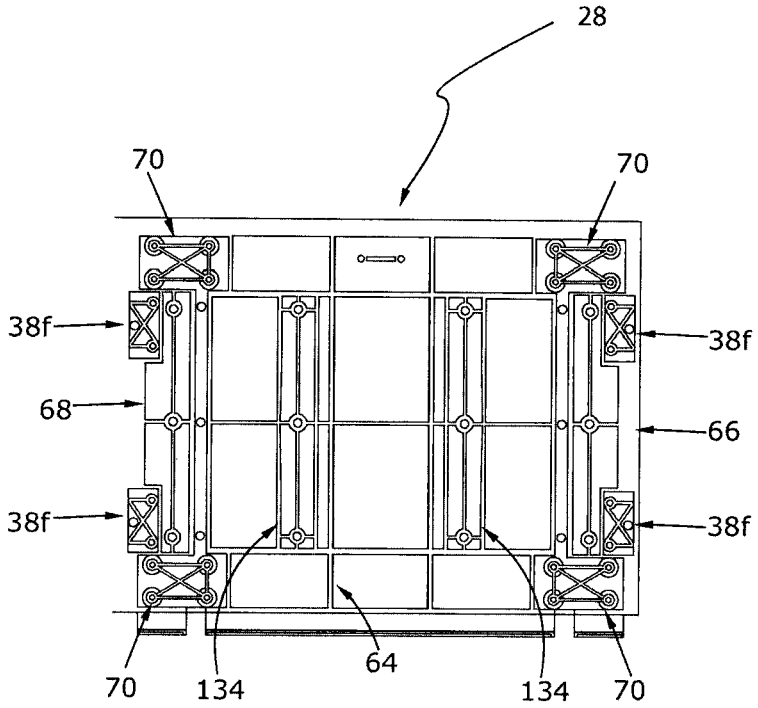
FIGS. 13A and 13B are bottom and top plan views of a floor panel of the first closet insert module.
Figure 13B:
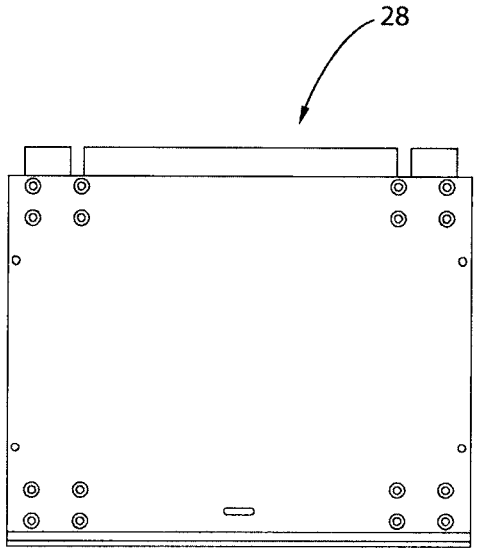

Referring to FIG. 13 in conjunction with FIG. 5A, floor panel 28 of intermediate insert module 23 has strengthening ribs 64 formed on its bottom surface. A pair of mounting structures 38*f* are provided along each of the right and left edge regions 66 and 68 of the bottom surface of floor panel 28 and open onto the right and left edges of the floor panel 28. The mounting structures 38*f* are identical to mounting structures 38*b* and 38*t* and are structured and arranged to have female members 44 of coupling devices 46 mounted thereon. A rectangular arrangement 70 of four threaded bores with interconnecting ribs is formed at each corner of the bottom surface of floor panel 28. A caster 72 is affixed to the rectangular bore arrangement 70 at each of the four corners of floor panel 28.

Figure 5B:
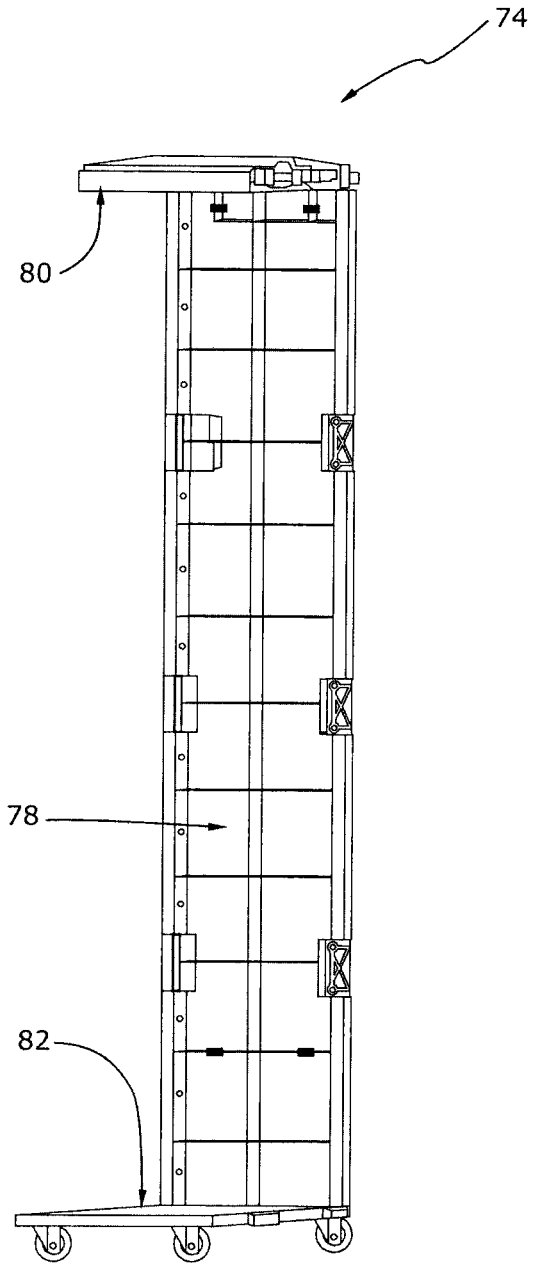
Figure 15A:
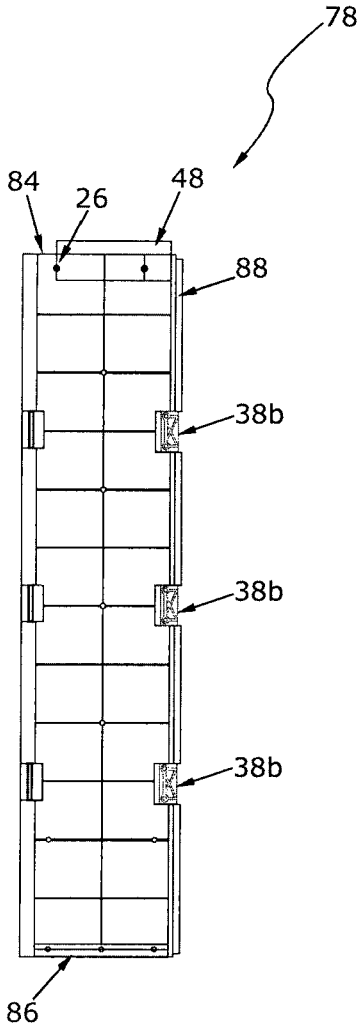
FIGS. 15A and 15B are front and rear elevation views of a back panel of a second closet insert module which constitutes the left module which constitutes the left module of the closet insert shown in FIGS. 3 and 4.
Figure 15B:
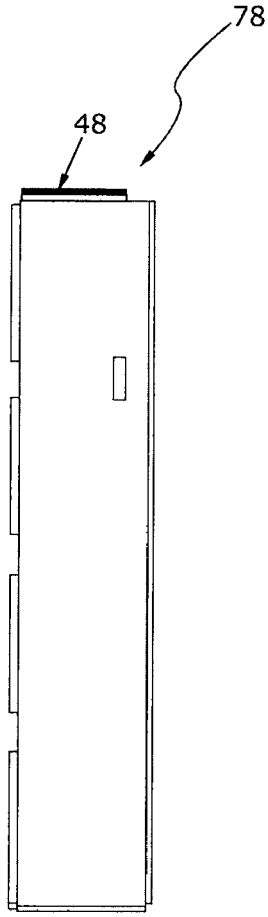
Figure 16A:
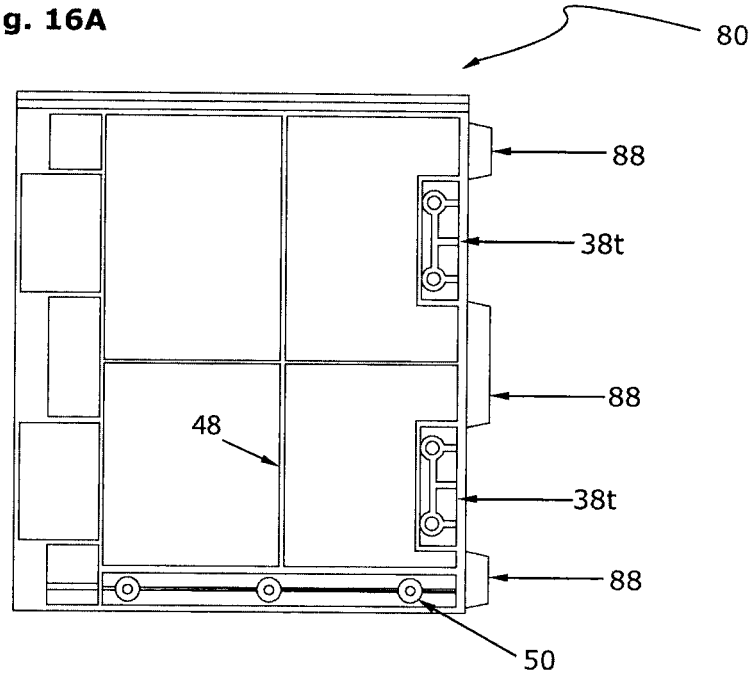
FIGS. 16A and 16B are bottom and top plan views of a top panel of the second insert module.
Figure 16B:
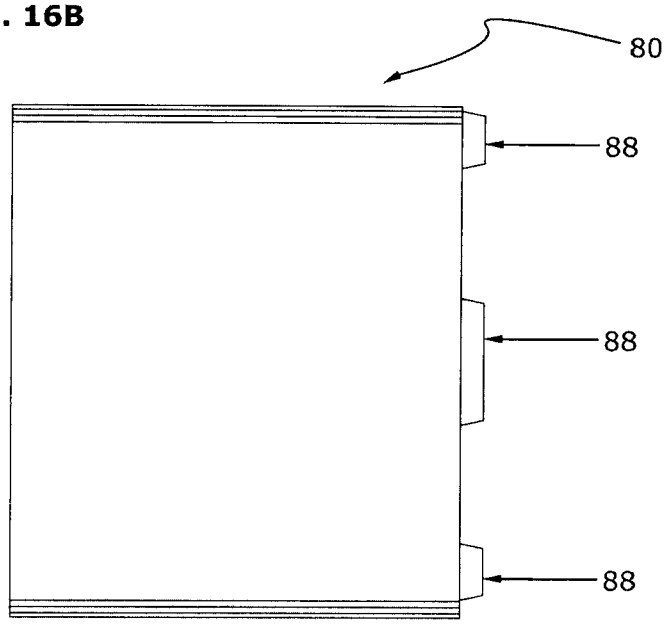
Figure 17A:
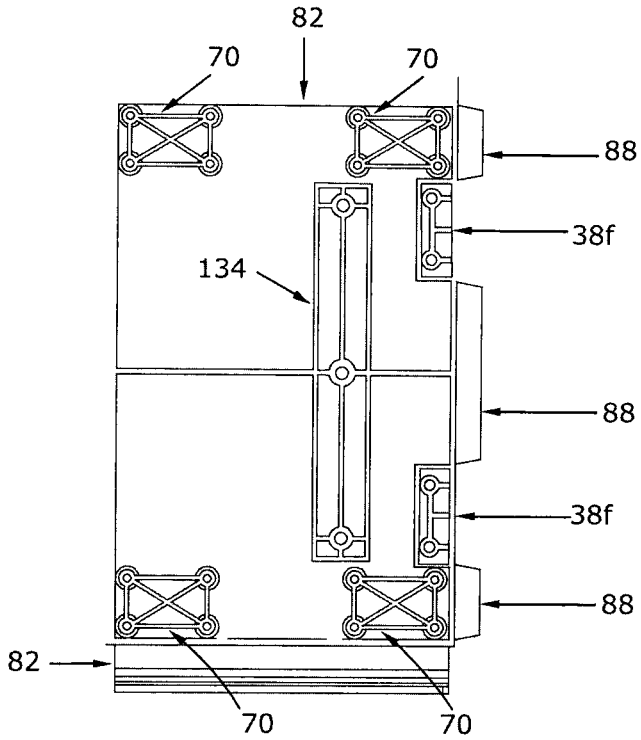
FIGS. 17A and 17B are bottom and top plan views of a floor panel of the second closet insert module.
Figure 17B:
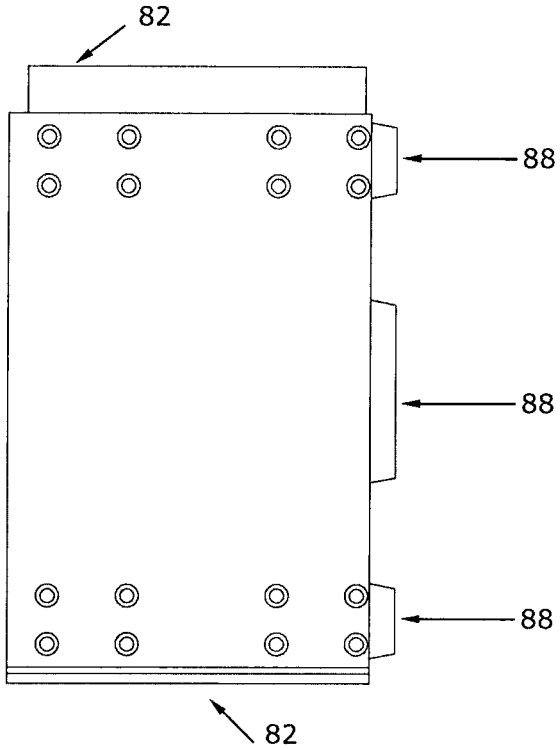

As noted above, in accordance with the invention, first closet insert module 23 can be used either by itself, i.e. without being coupled to other insert modules (see FIGS. 25-28), or in conjunction with one or more additional closet insert modules, to form a closet insert. Referring to FIGS. 3, 4 and 6-10, an embodiment is illustrated in which the first module 23 is coupled on its left side to a second or left closet insert module 74 and on its right side to a third or right closet insert module 76 so that module 23 functions as an intermediate module. As seen in FIG. 5B, left closet insert module 74 includes a substantially rectangular back panel 78 and substantially rectangular top and floor panels 80 and 82 extending from back panel 78. The height H of back panel 78 and depths D1 and D2 of top and floor panels 80 and 82 are the same as in the case of first insert module 23. The length L2 of the second module 74, however, is shorter than the length L1 of first module 23. As in the case of insert module 23, the back panel 78 of left module 74 is situated in a substantially vertical plane and includes upper and lower edge regions 84 and 86 to which the top and floor panels 80 and 82 are connected by threaded fasteners to extend in substantially horizontal planes perpendicular to the vertical plane in which the back panel 78 is situated. The back, top and floor panels 78, 80 and 82 of the second insert module 74 are shown in FIGS. 15, 16 and 17 respectively and features corresponding to those described above in connection with the back, top and floor panels 24, 26 and 28 of insert module 23 are designated by the same reference characters. It is noted that while coupling device mounting structures 38*b*, 38*t* and 38*f* are provided on both the right and left edge regions of the back, top and floor panels 24, 26 and 28 of module 23, mounting structures 38*b*, 38*t* and 38*f* are provided only on the right edge regions of the back, top and floor panels 78, 80 and 82 of left insert module 74. Tongue elements 88 extend from the right edges of the back, top and floor panels 78, 80 and 82 of left module 74. Casters 72 are affixed to the arrangements of threaded bores 70 on the bottom of floor panel 82.

Figure 19A:
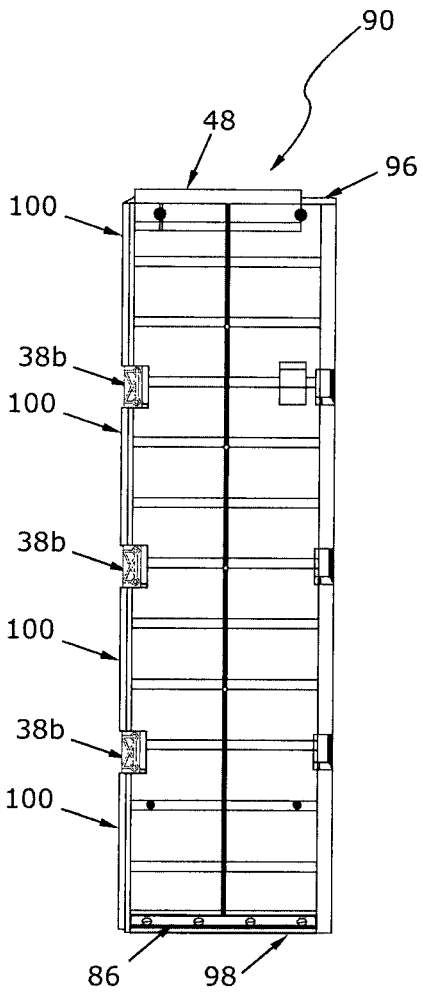
FIGS. 19A and 19B are front and rear elevation views of a back panel of a third closet insert module which constitutes the right module of the closet insert shown in FIGS. 3 and 4.
Figure 19B:
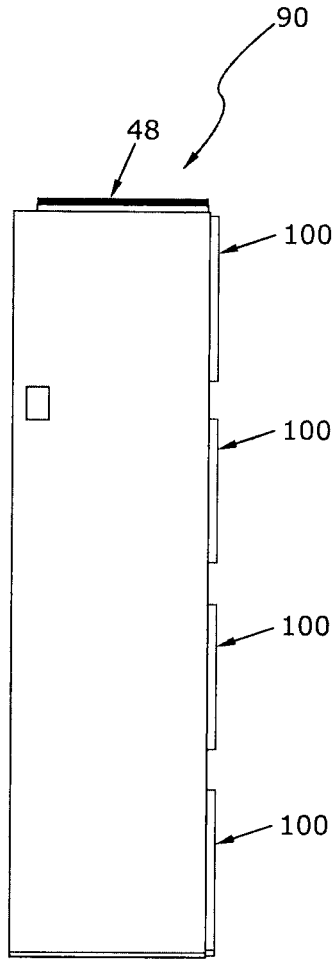
Figure 20A:
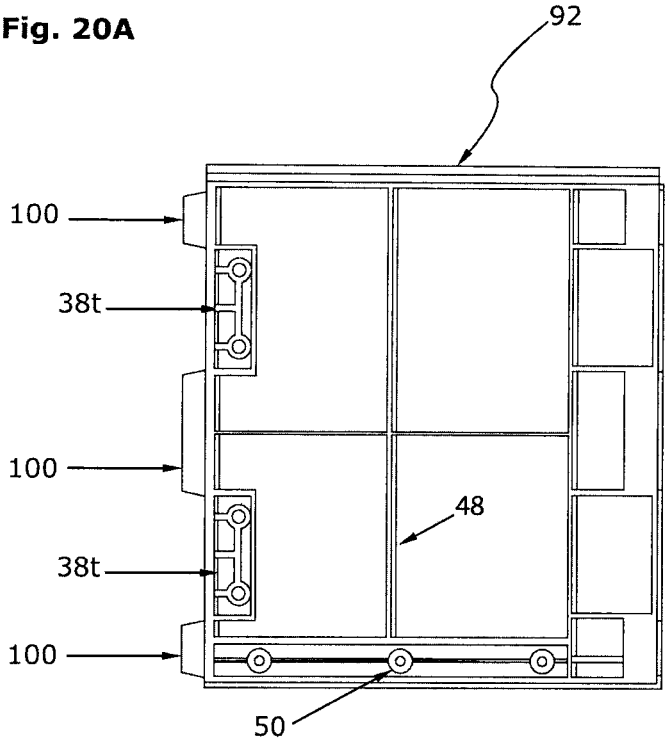
FIGS. 20A and 20B are bottom and top plan views of a top panel of the third closet insert module.
Figure 20B:
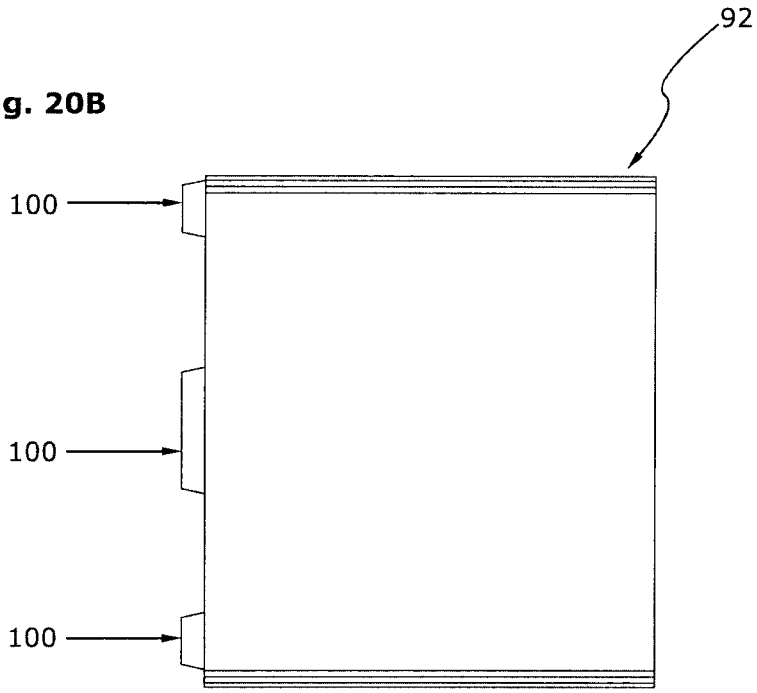
Figure 21A:
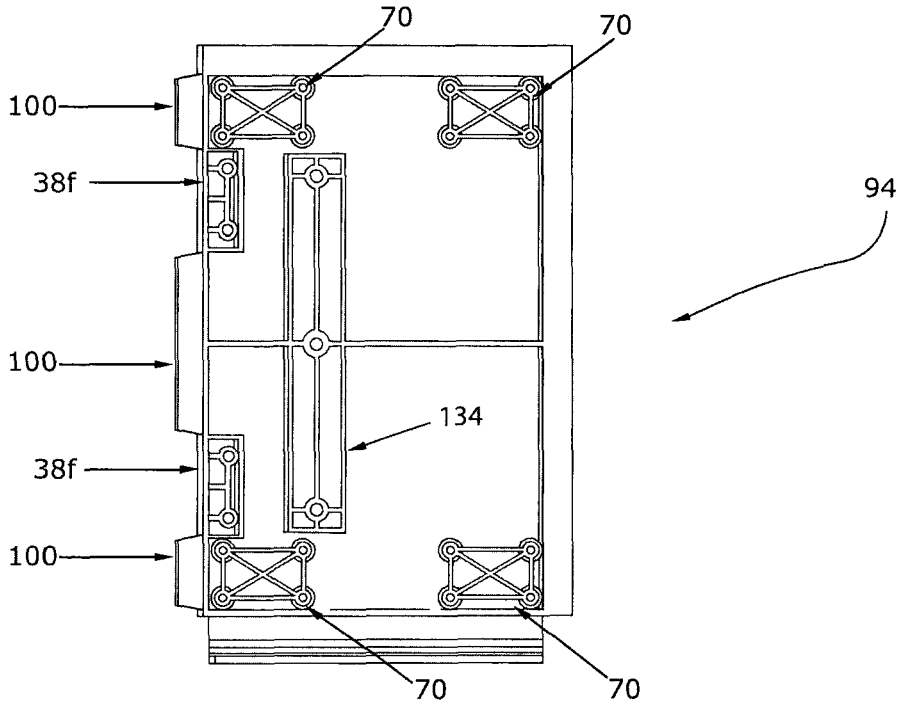
FIGS. 21A and 21B are bottom and top plan views of a floor panel of the third closet insert module.
Figure 21B:
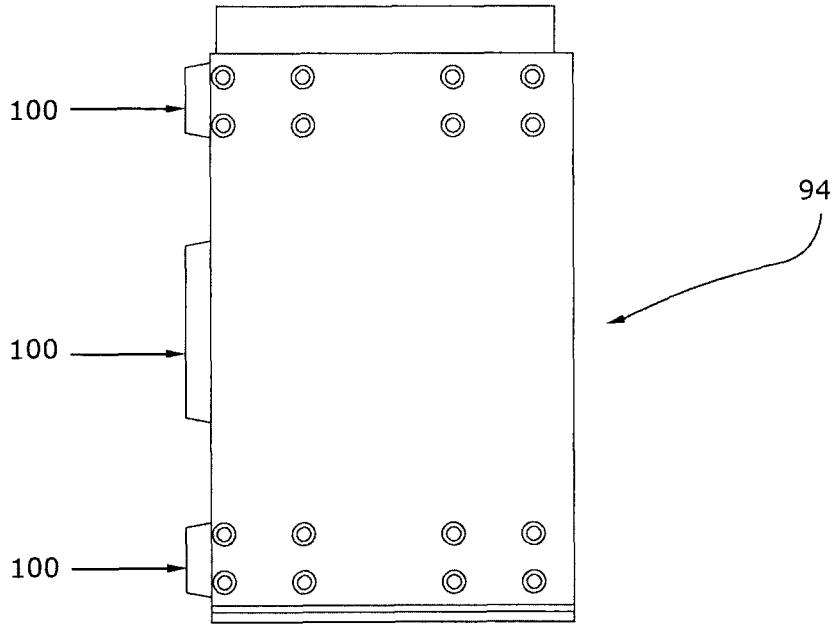

The third or right closet insert module 76 (FIG. 4) coupled to the right side of first or intermediate insert module 23 has a construction similar to the left insert module 74 and includes a substantially rectangular back panel 90 and substantially rectangular top and floor panels 92 and 94 extending from back panel 90. The height H of back panel 90 and the depths D1 and D2 of top and floor panels 92 and 94 of the third or right insert module 76 are the same as in the case of the first and second insert modules 23 and 74. The length L2 of right module 76 is the same as the length of the left module 74. As in the case of first and second modules 23 and 74, the back panel 90 of right module 76 is situated in a substantially vertical plane and includes upper and lower edge regions 96 and 98 to which the top and floor panels 92 and 94 are connected by threaded fasteners to extend in substantially horizontal planes perpendicular to the vertical plane in which the back panel 90 is situated. The back, top and floor panels 90, 92 and 94 of third or right insert module 76 are shown in FIGS. 19, 20 and 21 respectively and features corresponding to those described above in connection with the back, top and floor panels of insert modules 23 and 74 are designated by the same reference characters. It is noted that while coupling device mounting structures 38 are provided on both the right and left edge regions of the back, top and floor panels 24, 26 and 28 of first or intermediate module 23, and only on the right edge regions of the back, top and floor panels 78, 80 and 82 of second or left of module 74, mounting structures 38*b*, 38*t* and 38*f* are provided only on the left edge regions of the back, top and floor panels 90, 92 and 94 of right insert module 76. Tongue elements 100 extend from the left edges of the back, top and floor panels 90, 92 and 94 of right module 76. Casters 72 are affixed to the arrangements of threaded bores 70 on the bottom of floor panel 94.

Figure 9:
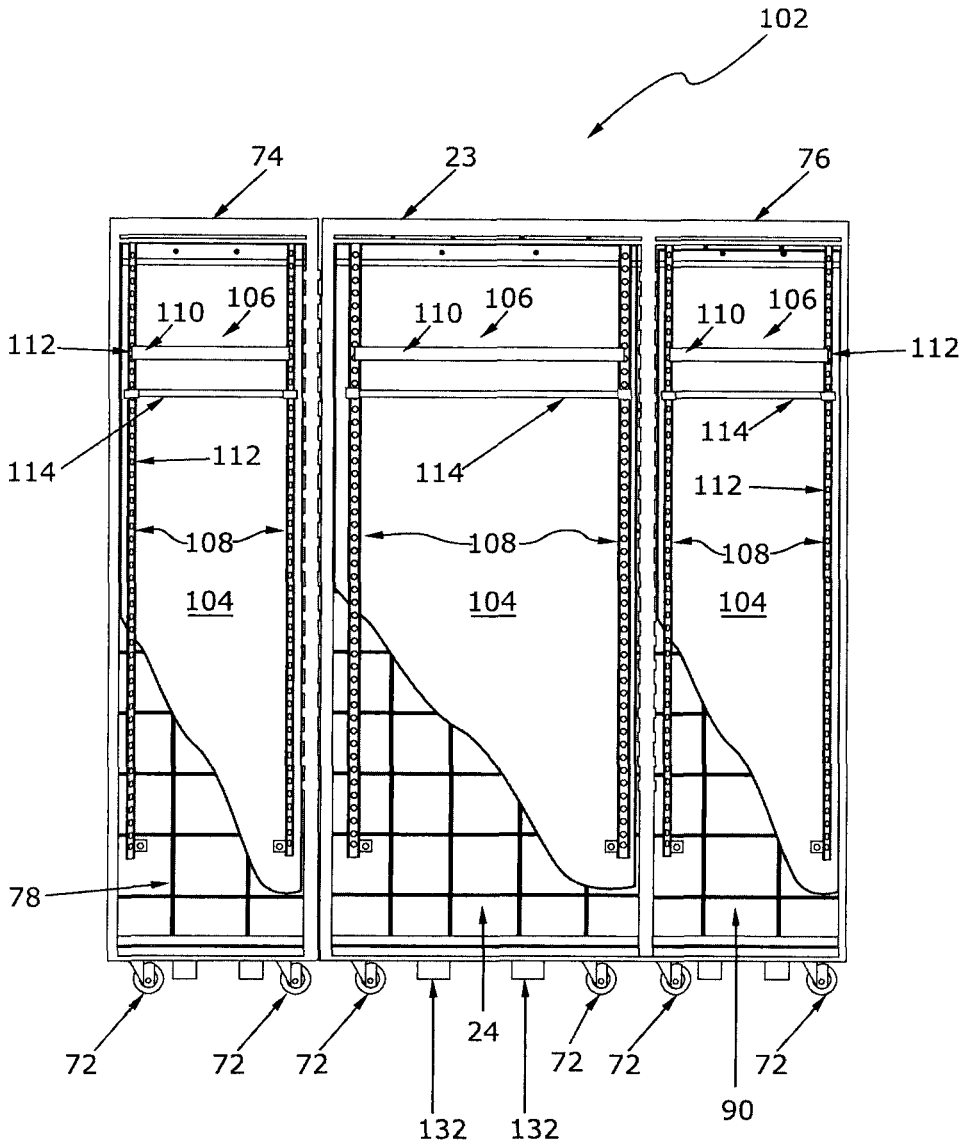
FIG. 9 is a front elevation view of the closet insert shown in FIGS. 3, 4 and 6 and showing closet organizing hardware and veneer facing affixed to panels of each of the closet insert modules.

Referring to FIG. 9, the inwardly facing surface of at least the back panels 24, 78 and 90 of each of the closet insert modules 23, 74 and 76 of closet insert 102 is covered by a veneer 104 and closet organizer hardware, generally designated 106, is hung from at least those back panels. Thus, each closet insert module, prior to being coupled to any other insert module, and prior to being inserted into a closet enclosure, is provided with closet organizer hardware. In the illustrated embodiment, closet organizer hardware 106 includes, in each module, a pair of support rails 108 fastened to the respective back panel, a shelf 110 supported by brackets 112 hung from support rails 108, and a hanger bar 114 also suspended from support rails 108. Bores are molded into the back panel at regular intervals for connection of the hardware 106, which may also include additional shelving, drawers, tie racks and the like. The bores may be spaced to accommodate such closet organizing systems as those marketed under the trademarks California Closets™, Elfa™, Container Store™, Closet Maid™, and the like.

Figure 24A:
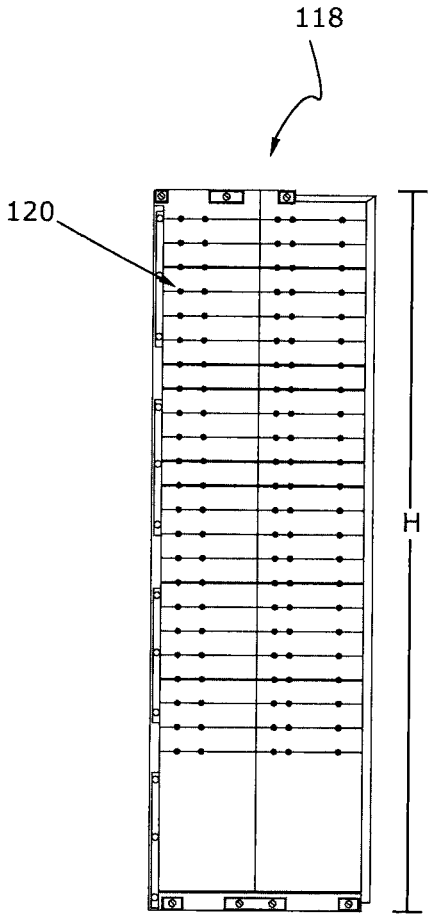
FIGS. 24A and 24B are left and right side elevation views of a right end panel of a closet insert.
Figure 24B:
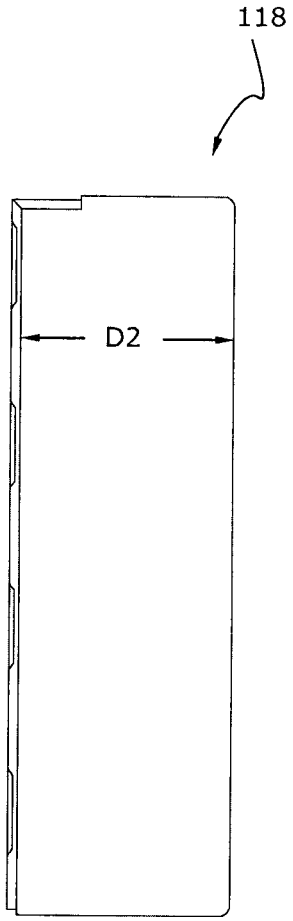
Figure 25:
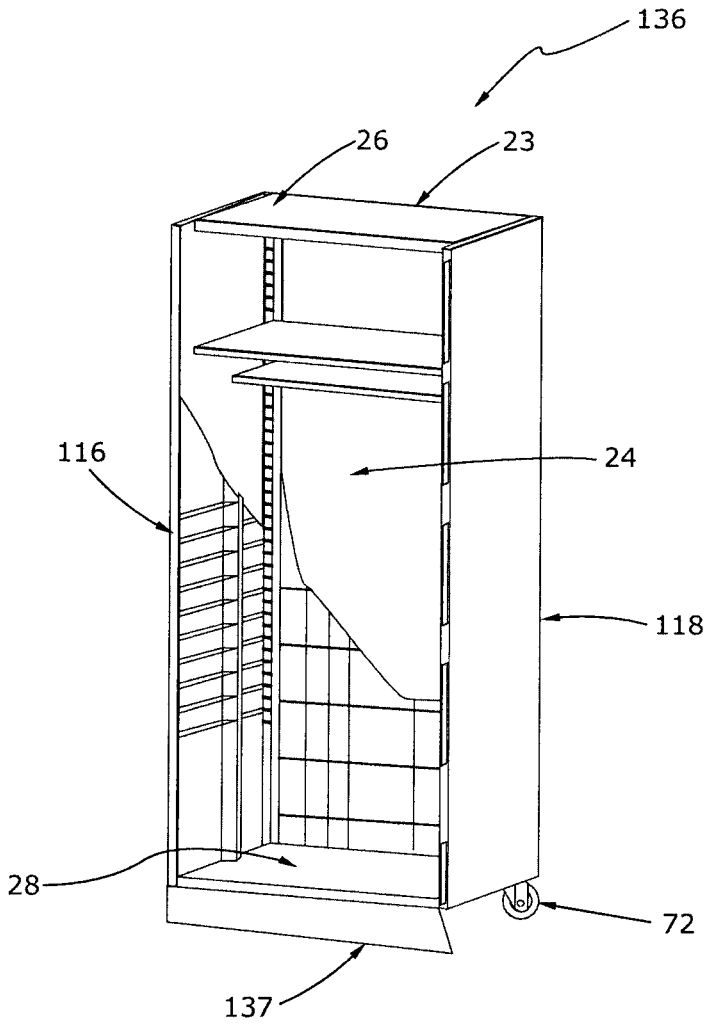
FIG. 25 is a front perspective view of a closet insert in accordance with the invention comprising a single closet insert module, a pair of end panels and closet organizing hardware.
Figure 26:
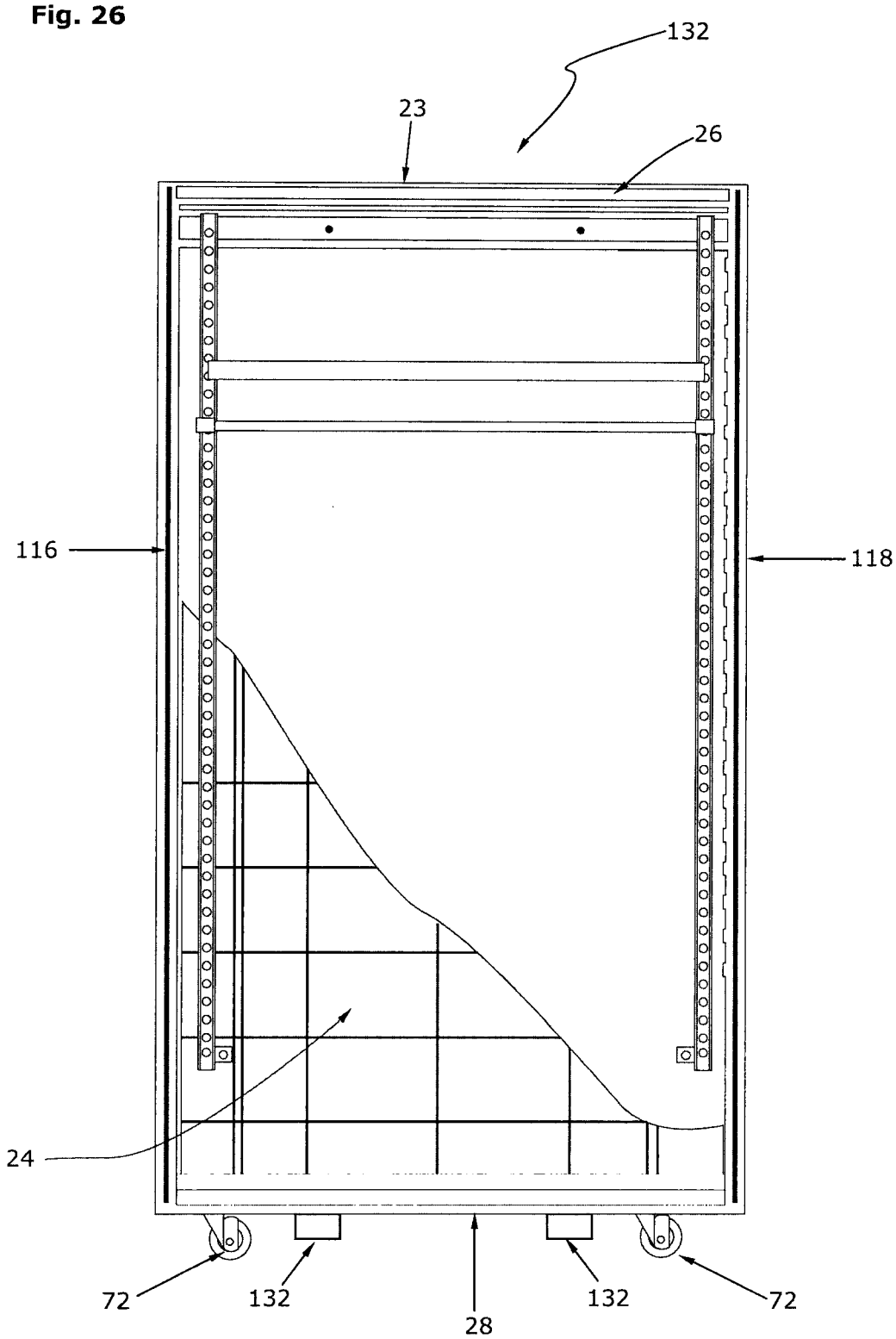
FIG. 26 is a front elevation view of the closet insert shown in FIG. 25 showing closet organizing hardware and veneer facing affixed to the panels thereof.
Figure 27:
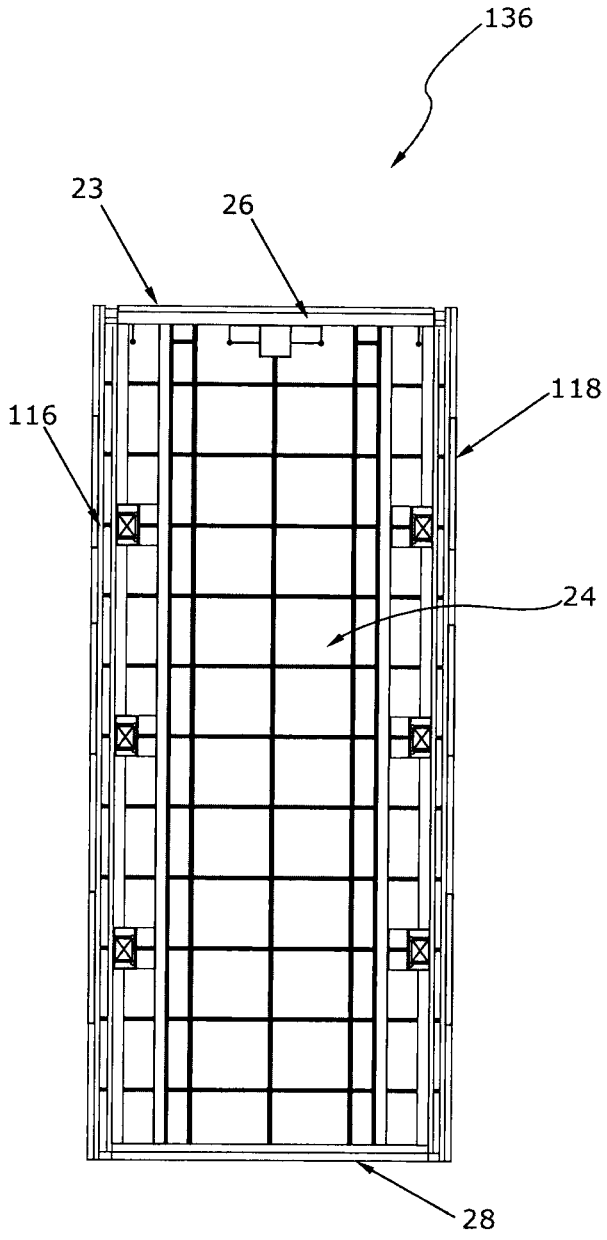
FIG. 27 is a front elevation view of the closet insert shown in FIGS. 25 and 26 without the closet organizing hardware.
Figure 28:
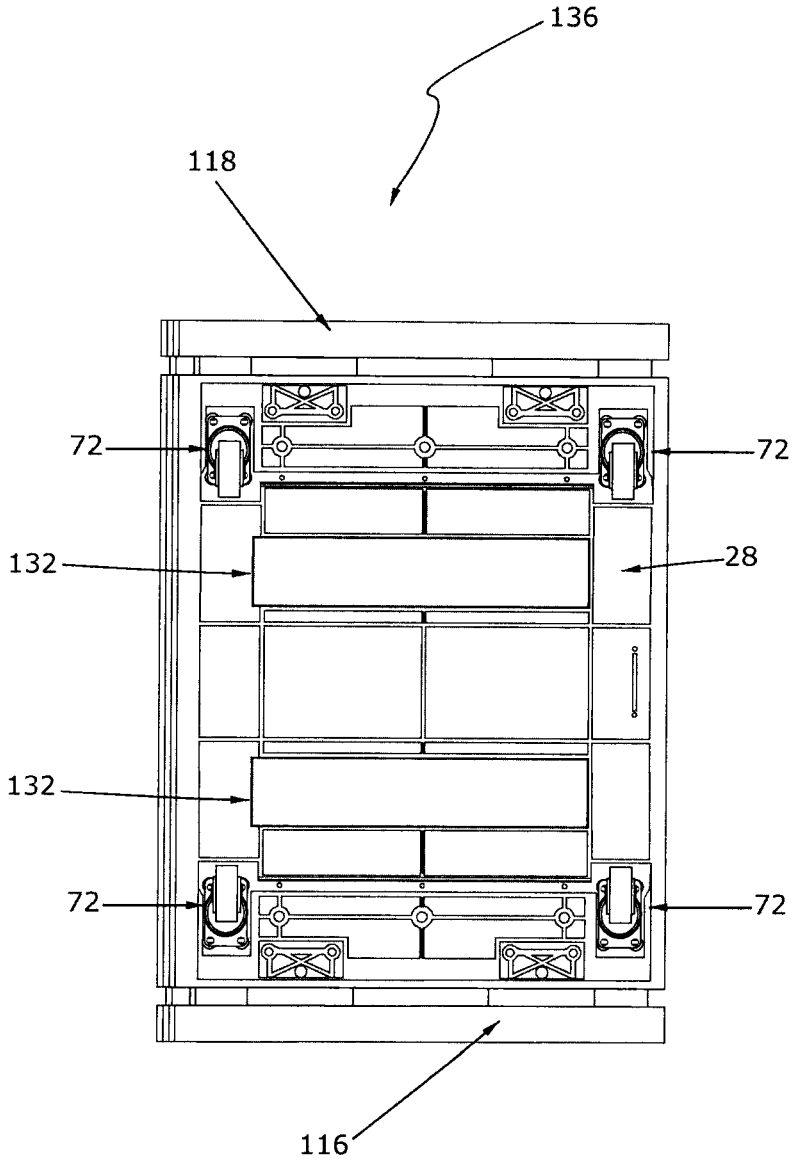
FIG. 28 is a bottom plan view of the closet insert shown in FIGS. 25-27.

A rectangular left end panel 116 (FIG. 23) is connected by threaded fasteners to the left edge regions of the panels of the second or left module 74 and a rectangular right end panel 118 (FIG. 24) is connected by threaded fasteners to the right edge regions of the panels of the third or right module 76, perpendicular to the planes in which the back, top and floor planes are situated. The end panels 116 and 118 have a height H equal to the height H of the back panels 24, 78 and 90 and a depth D2 equal to the depth D2 of the floor panels 28, 82 and 94. The inner surface of each of the end panels 116 and 118 are molded with bores 120 to provide connection points for additional closet organizing hardware.

Figure 6:
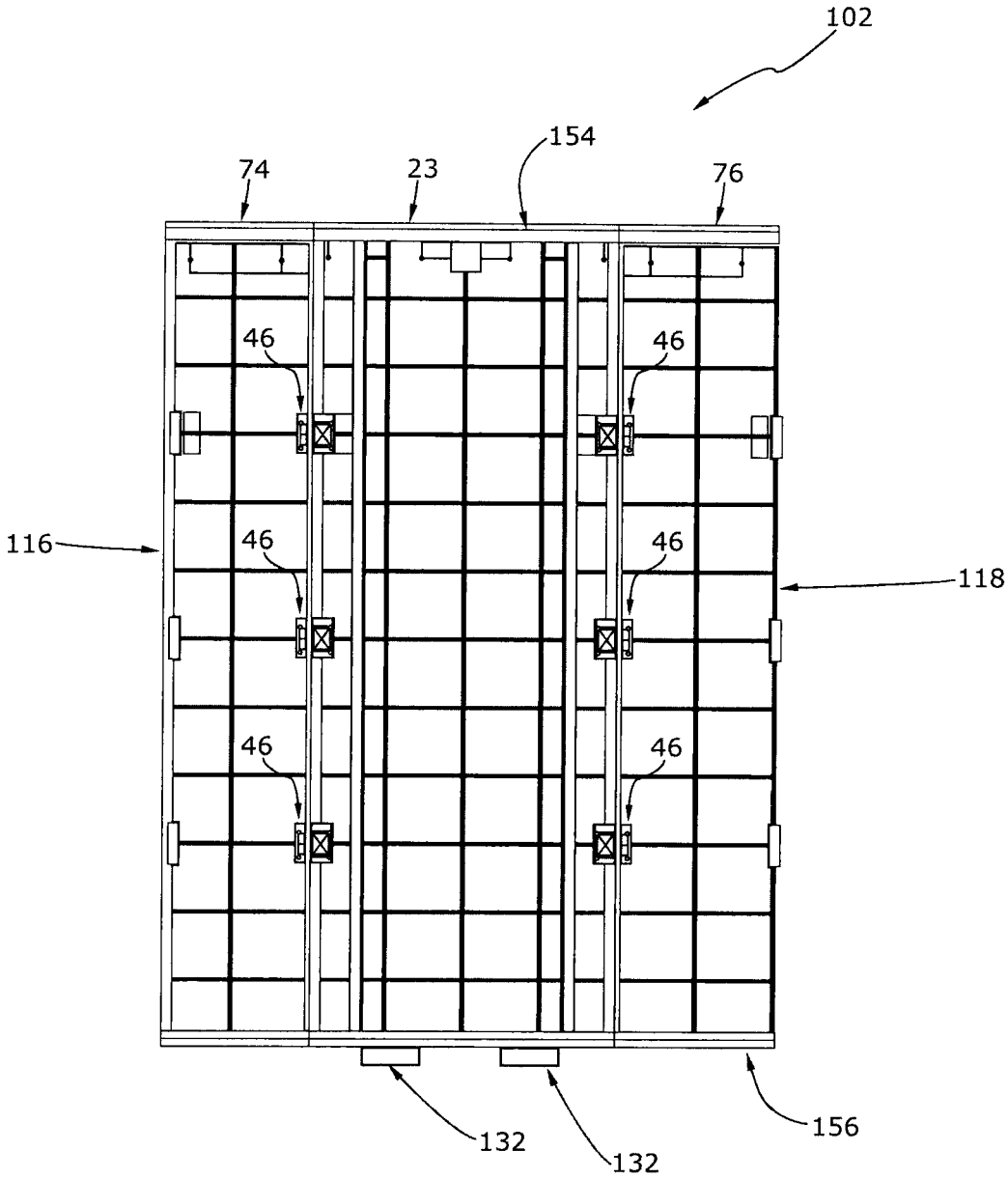
FIG. 6 is a front elevation view of the closet insert shown in FIGS. 3 and 4.
Figure 7:
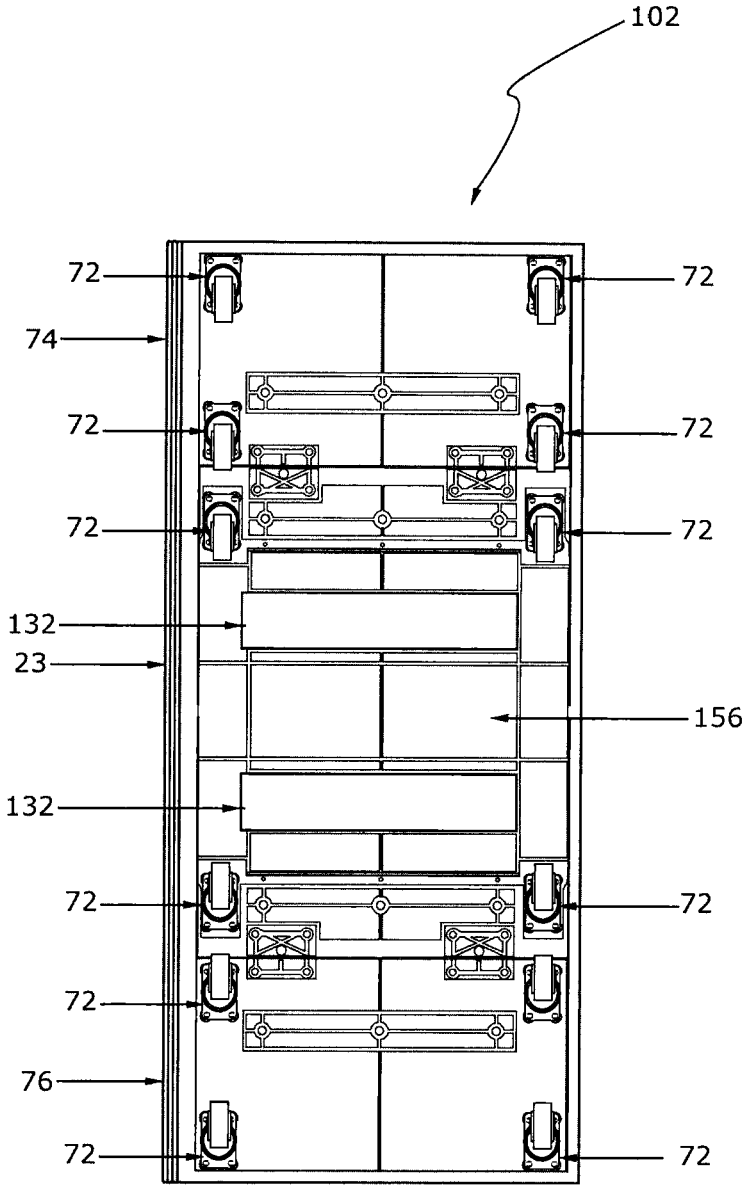
FIG. 7 is a bottom view of the closet insert shown in FIGS. 3, 4 and 6.
Figure 8:
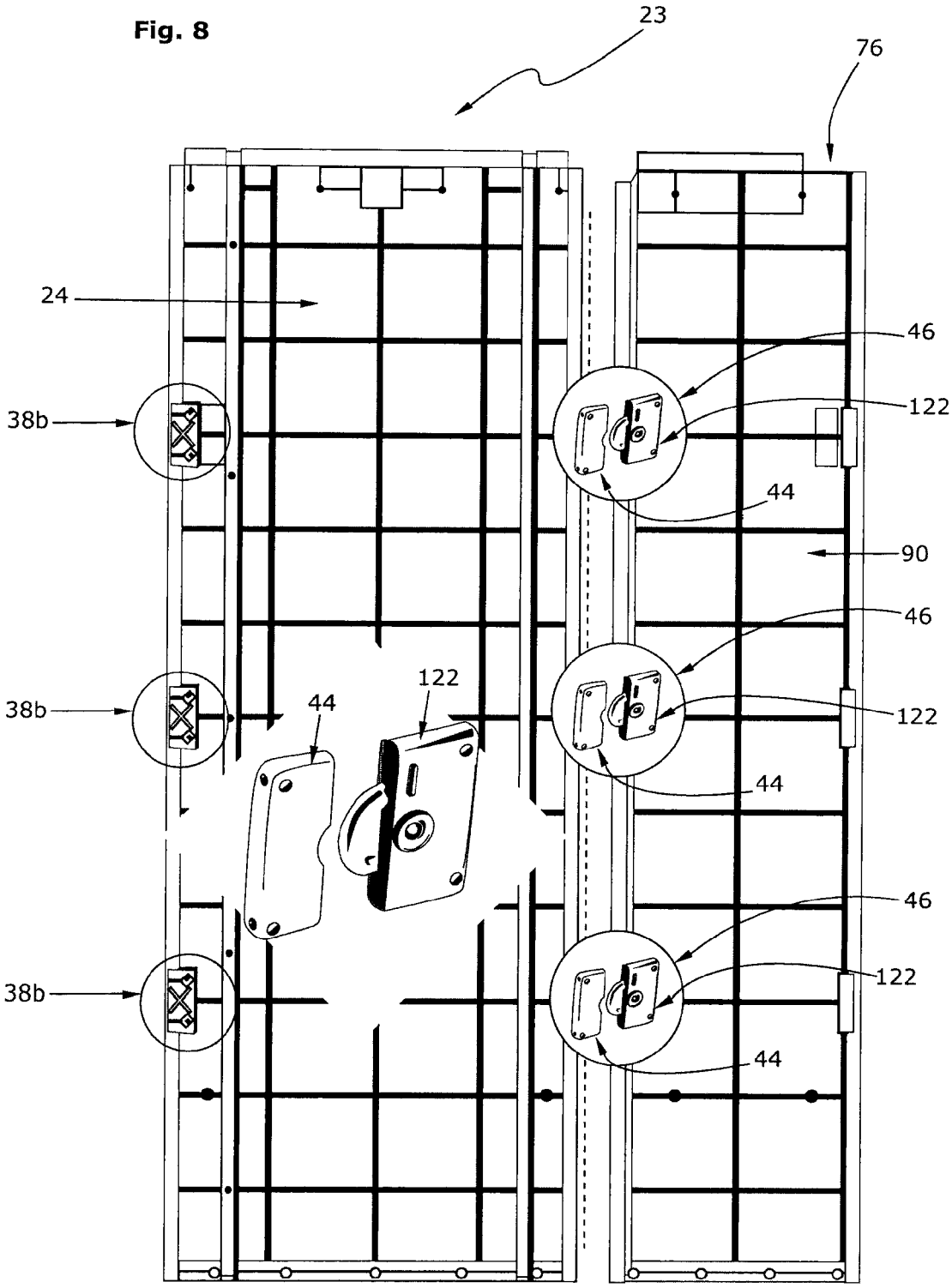
FIG. 8 is a front elevation view of a pair of back panels of two closet insert modules showing coupling devices mounted on coupling device mounting structures for coupling the insert modules to each other in accordance with the invention.

As best seen in FIGS. 3, 6 and 8, the closet insert 102 (with the closet organizer hardware 106 and veneer omitted for clarity) is formed by coupling the third or right insert module 76 to the left side of first or intermediate insert module 23 and coupling the second or left insert module 74 to the right side of first or intermediate insert module 23. The tongue elements 88 of the panels of the second or left module 74 are received within grooves (not shown) formed in the left edge regions of the panels of the first or intermediate module 23 while the tongue element 100 of the panels of the third or right module 76 are received within grooves (not shown) formed in the right edge regions of the panels of the intermediate module 22. The tongue and groove connections provide water resistant seals at the seams between the panels.

Male coupling members 122 of coupling devices 46 are mounted on the mounting structures 38*b*, 38*t* and 38*f* of the back, top and floor panels of the left and right insert modules 74 and 76 and female coupling members 44 of the coupling devices 46 are mounted on the mounting structures 38*b*, 38*t* and 38*f* of the panels of the intermediate module 23. The mounting structures 38 are arranged on the various panels of the modules so that the male and female coupling members 122 and 44 on the respective panels are in aligned relationship when the respective modules are positioned next to each other. This is best illustrated in FIG. 8 in which the male and female coupling members 122 and 44 mounted on the mounting structures 38*b* of the back panel 90 of right insert module 76 and the back panel 24 of intermediate module 23 respectively are shown in aligned relationship prior to coupling the modules together.

Figure 10:
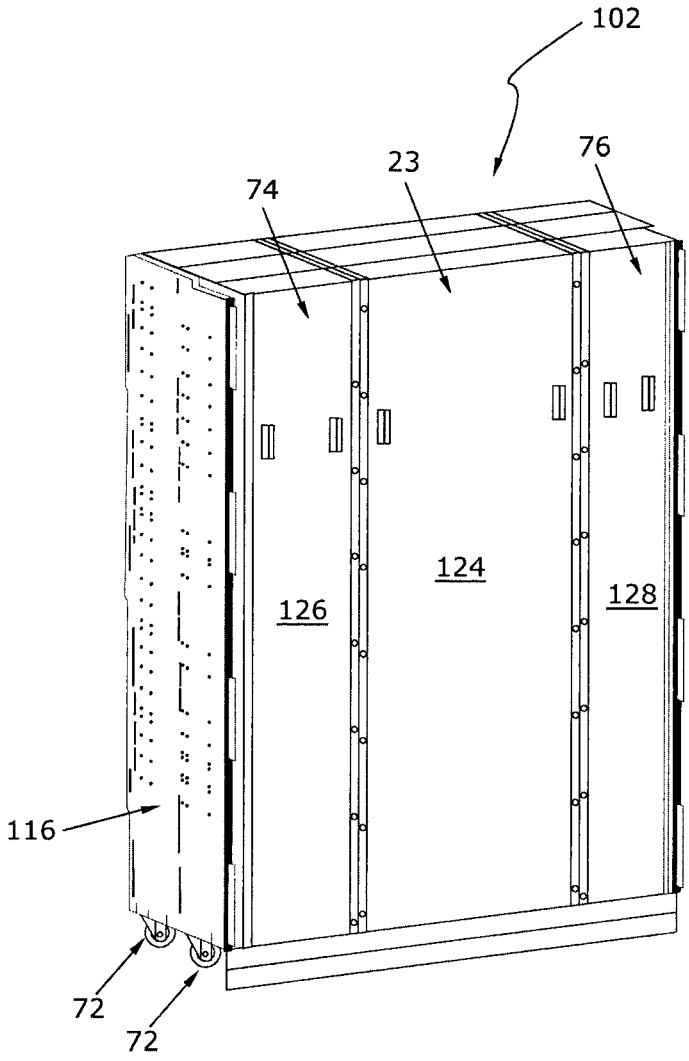
FIG. 10 is a perspective view of the closet insert shown in FIGS. 3, 4 and 9 and showing door members attached to each of the closet insert modules.
Figure 18A:
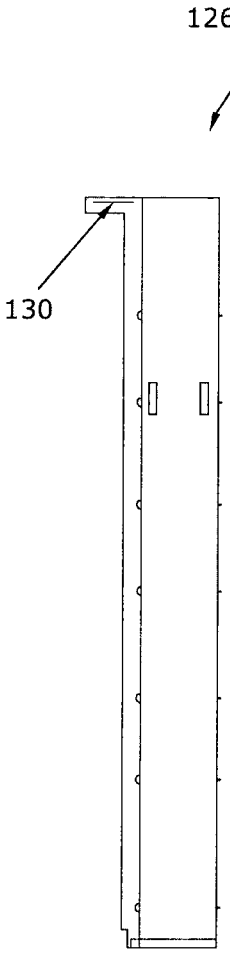
FIG. 18A is a front left side perspective view of a door panel for the second closet insert module.
Figure 18B:
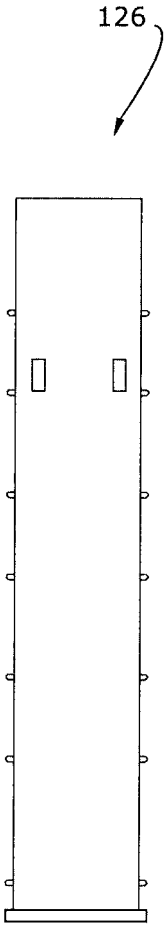
FIG. 18B is front view of the door panel shown in FIG. 18A.
Figure 18C:
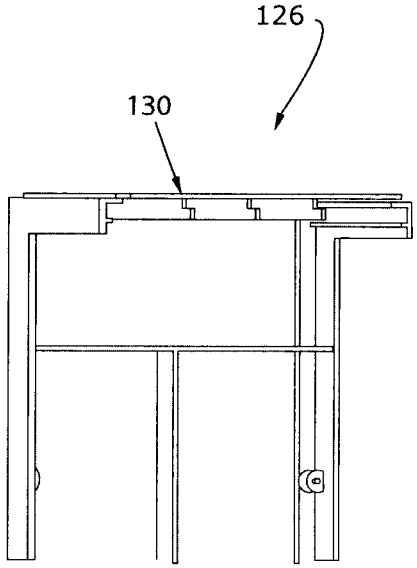
FIG. 18C is a partial rear left side perspective view of the door panel shown in FIGS. 18A and 18B.
Figure 22:
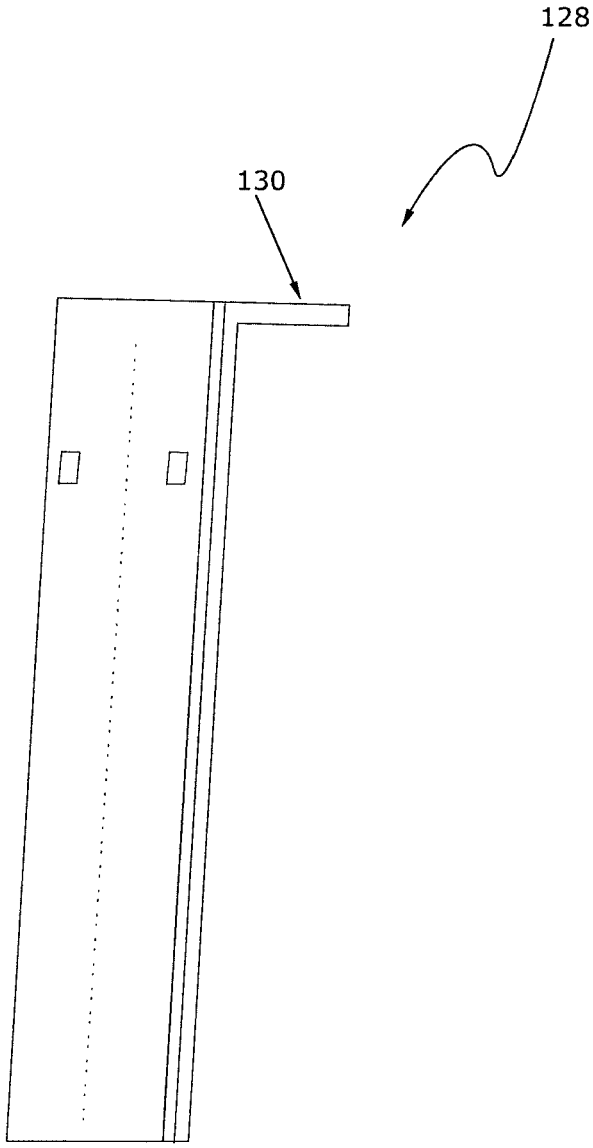
FIG. 22 is a left side perspective view of a door panel of the third closet insert module.
Figure 23A:
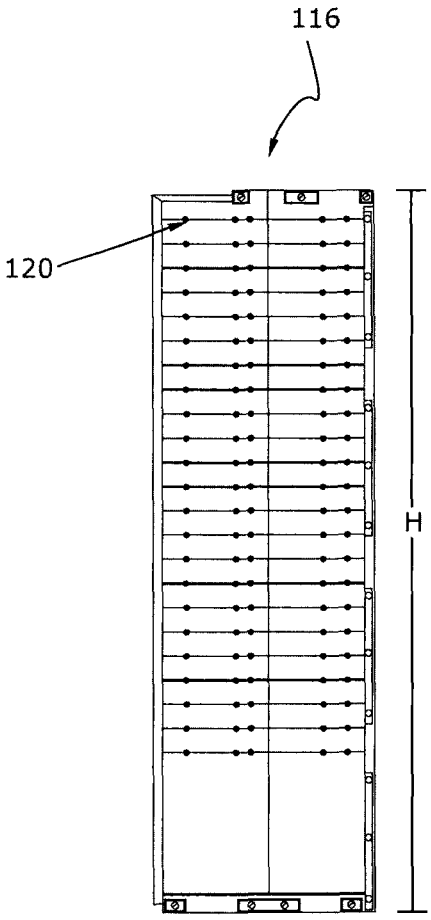
FIGS. 23A and 23B are right and left side elevation views of a left end panel of a closet insert.
Figure 23B:
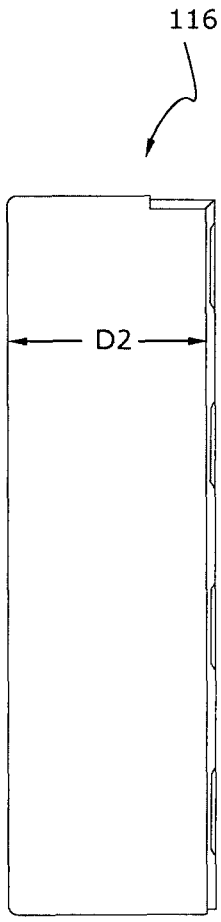
Figure 23C:
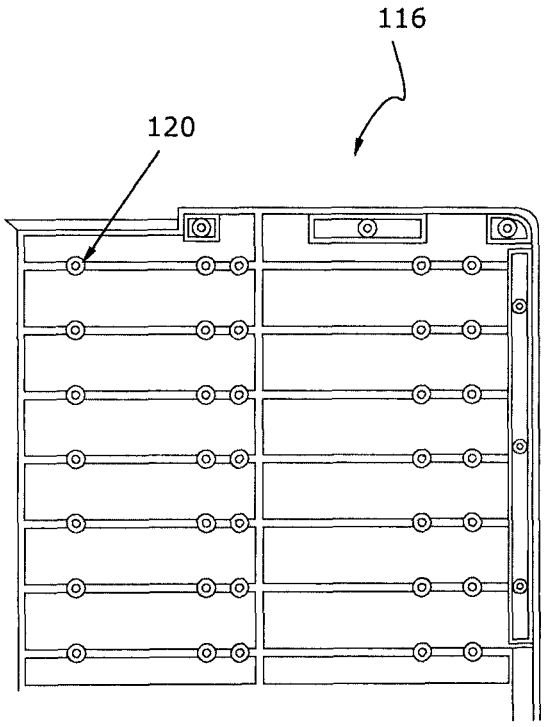
FIG. 23C is a right side partial perspective view of the left end panel shown in FIGS. 23A and 23B.
Figure 23D:
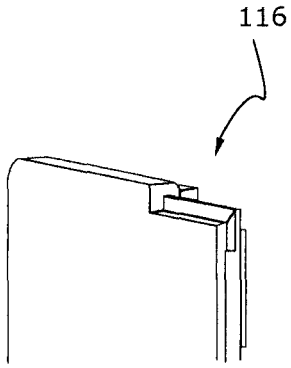
FIG. 23D is a left side partial perspective view of the left end panel shown in FIGS. 23A-23C.

The male and female coupling members on the respective top and floor panels are in similar alignment. The coupling devices 46 are cam lock devices which compress the mating edges of the panels of the modules against each other when coupling is accomplished insuring reliable water-resistant seams between the coupled modules In the manner described in connection with FIG. 2, the insert modules 23, 74 and 76, with end panels 116 attached to modules 74 and 76, are inserted into a closet enclosure before they are coupled to each other. Once properly positioned in the closet enclosure, the modules are coupled to each other by coupling devices 46 as described above to form the closet insert 102. Clothes may then be hung or otherwise situated in the closet insert 102 as if it were the closet itself. If and when it is desired to transport the clothing situated in the closet to the a remote location, such as a storage facility, the modules are de-coupled from each other and removed from the closet enclosure while the clothing is situated in each enclosure. After removing the modules from the closet enclosure, the modules are re-coupled to each other with the clothing still situated in the modules. At this time, as best seen in FIG. 10, a door panel is affixed to each respective closet insert to close the closet insert with the clothing situated therein. In particular, a door panel 124 (FIG. 14) is affixed to the intermediate module 23, a door panel 126 (FIG. 18) is affixed to the left insert module 74 and a door panel 128 (FIG. 22) is affixed to the right module 76. The depth D1 of the top panels, 26, 80 and 92 is less then the depth D2 of the floor panels 28, 82 and 94 in order to enable easy hanging of clothes from a top hanger bar and to facilitate accessibility to the upper surface of the top panels which can be useful as additional shelf space. For this reason each door panel is formed with a horizontal top portion 130 the rearward edge surface of which mates with the forward edge surface of each top panel. The mating edge surfaces are formed with tongue and groove connections to insure water-resistance. The door panels are affixed to their respective insert modules by molded couplers. The door panels are also provided with locks so that once they are affixed to the respective closet modules they cannot be removed by unauthorized personnel. This feature provides security for the contents of the closet insert during transportation and storage.

Figure 31:
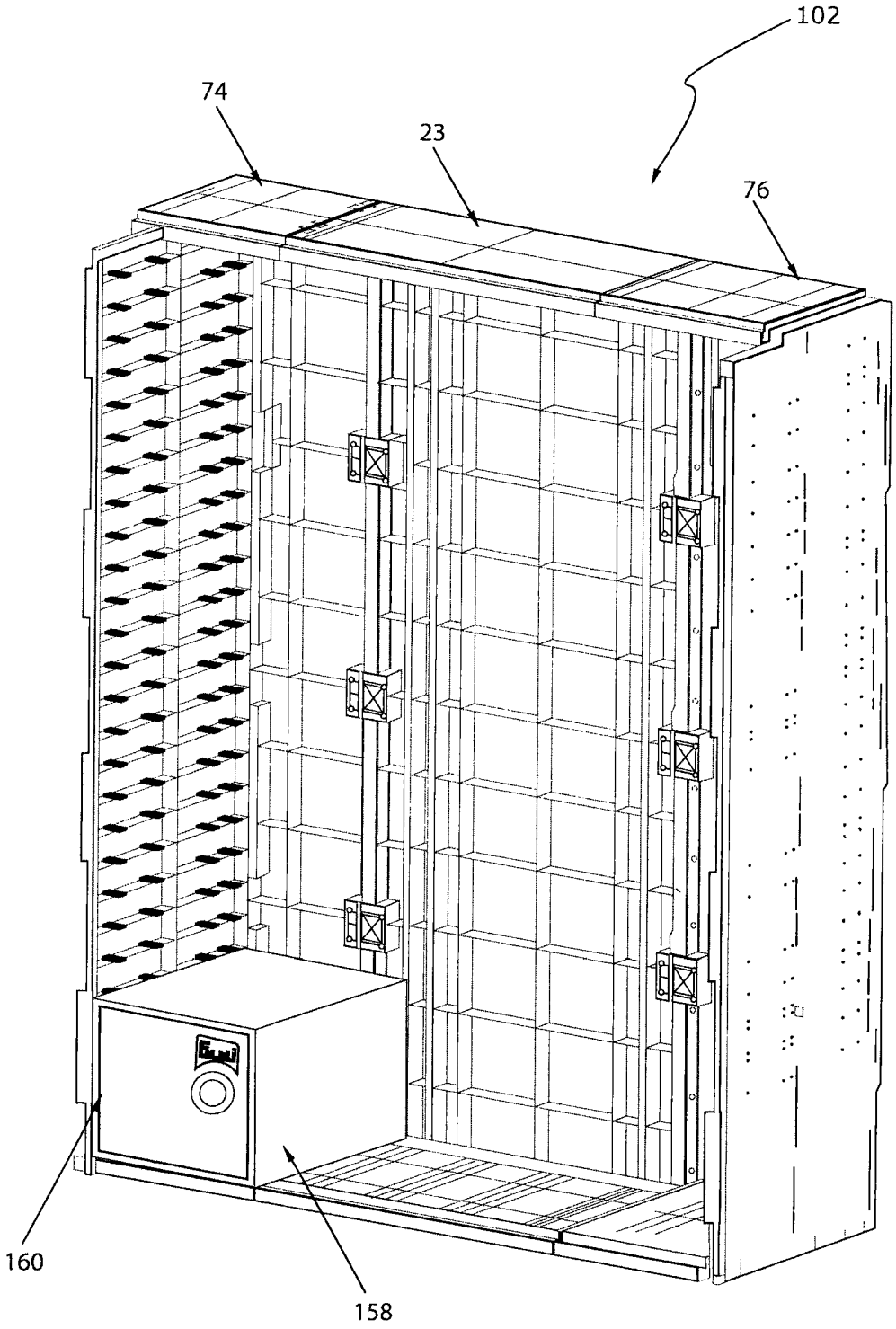
FIG. 31 is partial perspective view of a closet insert in accordance with the present invention illustrating a safe that is built into the closet insert.

Referring to FIG. 31, the left module 74 of the closet insert 102 preferably includes a built-in safe formed by a rectangular frame 158, the floor, end and back panels, and a door 160 hinged to the frame 158. The safe can be provided in other ones of the modules. The door 160 with the combination locking system can be removed from the frame of an outgoing closet insert and hinged to the safe frame of an incoming exchange closet insert.

After the door panels 124, 126 and 128 are affixed to the closet insert 102, the closet insert can be rolled on casters 72 out of the home or apartment or to another area of the residence. The door panels and rear wall panels have built in grab channels to facilitate handling and transporting. In order to facilitate transport of the closed insert to a location remote from the residence, such as a storage facility, a pair of channels 132 are affixed in parallel to the bottom surface of at least one of the floor panels. The channels are spaced from each other so as to be matable with standard fork-lift apparatus. As best seen FIGS. 13A, 17A and 21A, the bottom surface of the floor panels 28, 82 and 94 are provided with arrangements 134 of ribs and associated bolt holes structured to position the channels 132 for affixation to the bottom of the panels at appropriate positions depending upon the construction of the particular closet insert. When the closet insert is situated in a closet enclosure, elongate weights formed of heavy metallic material, can be situated within each channel to improve the stability of the closet insert.

Referring now to FIGS. 25-28, an embodiment of a closet insert 136 in accordance with the invention is shown comprising only a single first insert module 23. Such a closet insert is indicated where the length of the closet enclosure is greater than L1 but less than L1+L2. In this embodiment the end panels 116 and 118 are attached by threaded fasteners to the back, top and floor panels 24, 26 and 28 of insert module 23 to extend at right angles from the back panel 24 between the top and floor panels 26 and 28. Coupling devices 46 are not mounted on mounting structures 38*b*, 38*t* and 38*f* of any of the back, top and floor panels of the insert module 23, i.e. coupling devices are omitted entirely from the construction of the closet insert 136. Casters 72 and lifting channels 132 are affixed to the bottoms of floor panel 28. A kickplate 137 is fastened to the forward edge of the floor panel of the closet insert 136 and is constructed to extend towards the floor on which the closet insert 136 rolls on casters 72 but terminating slightly above the floor so as not to impede the smooth rolling of the closet insert casters 72. The kickplate serves as a support should the closet insert tilt forwardly, such as if the user steps on the front of the floor panel. It also serves to obstruct the view of casters 72 thereby improving the aesthetics of the closet insert.

Figure 29:
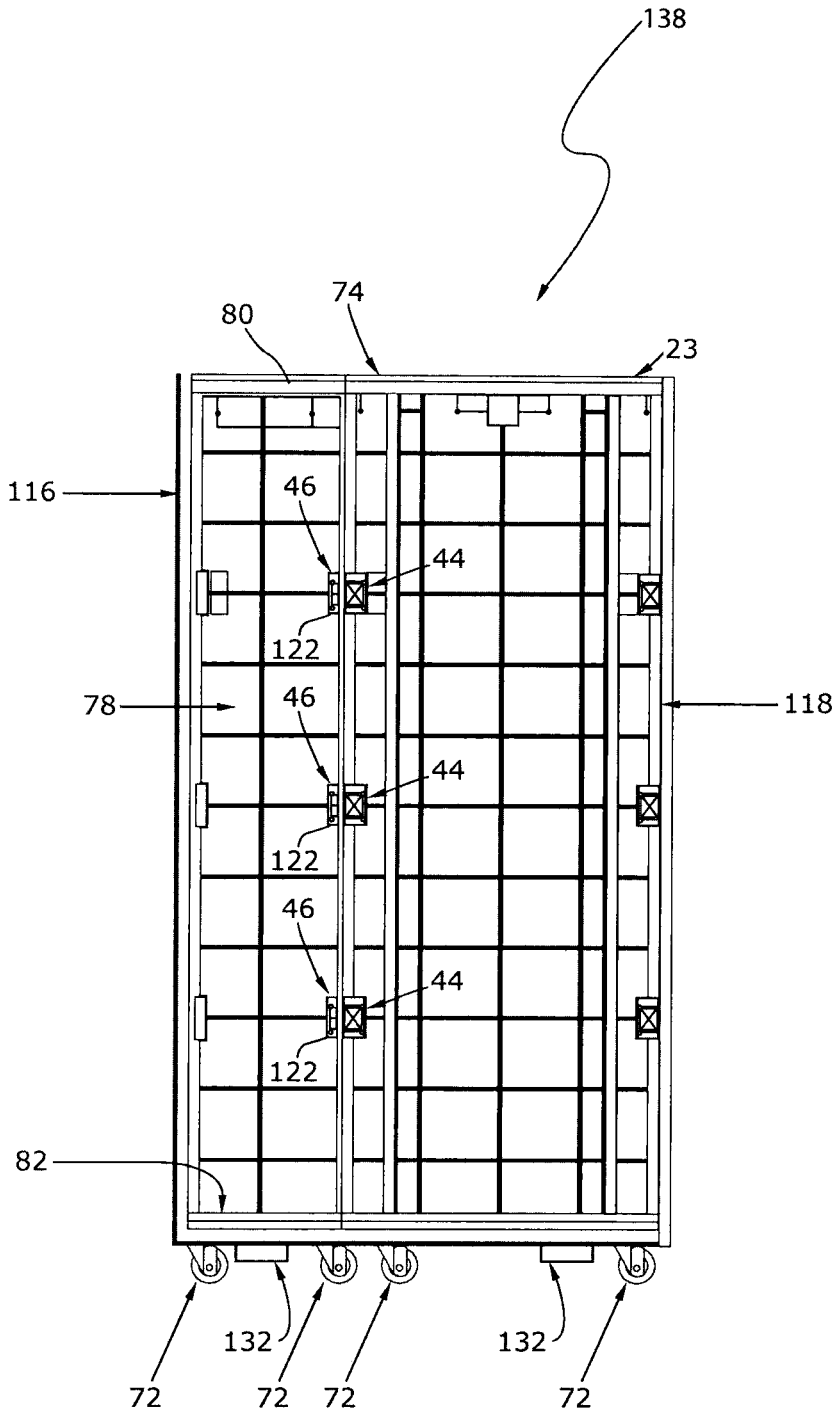
FIG. 29 is a first elevation view of a closet insert in accordance with the invention comprising two closet insert modules and a pair of end panels.
Figure 30:
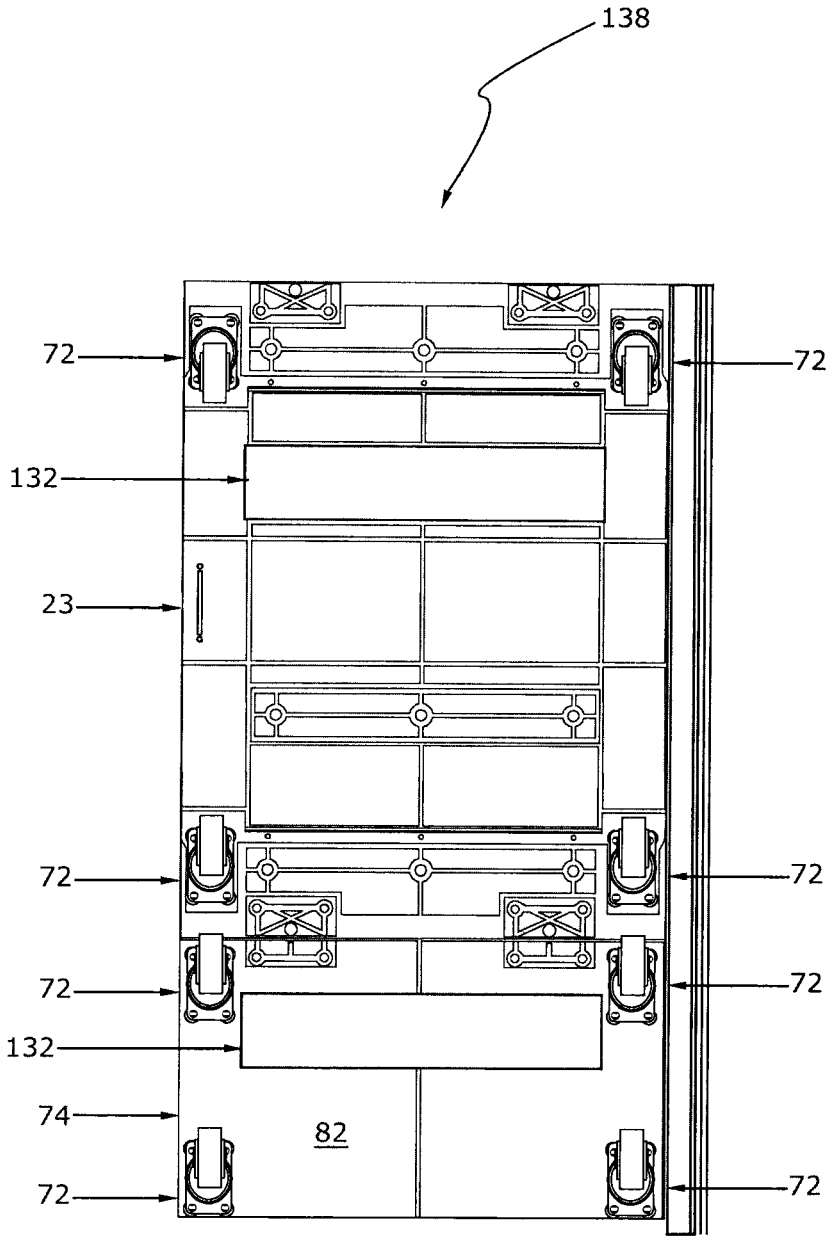
FIG. 30 is a bottom plan view of the closet insert shown in FIG. 29.

Referring to FIGS. 29-30, an embodiment of a closet insert 138 in accordance with the invention is shown comprising two modules coupled to each other, namely insert module 23 and second left insert module 74. Such a closet insert is indicated where the closet enclosure has a length greater than L1+L2 but less than L1+L2+L2. In this embodiment, male coupling members 122 are mounted on mounting structures 38*b*, 38*t* and 38*f* at the right edge regions of the back, top and floor panels 78, 80 and 82 of left insert module 74 and corresponding female coupling members 44 are mounted on mounting structures 38 at the left edge regions of the panels of insert module 23. Left and right end panels 116 and 118 are threadedly connected to the left and right edge regions of the insert modules 74 and 22 respectively. Casters 72 and lifting channels 132 are affixed to the bottom surfaces of floor panels 82 and 28 respectively.

Other combinations of closet insert modules are possible within the scope of the present invention. For example, a closet insert may comprise a single one of the second or third insert modules 74 or 76 having a pair of end panels 116, 118 affixed thereto. Other closet inserts can comprise a pair of first insert modules 23 coupled to each other with end panels 116, 118 or a pair of coupled first insert modules 23, each of which is coupled at its end with a second and third insert module 74, 76 respectively.

In accordance with a method of the invention, for example, during warmer months of the year, a first closet insert constructed according to the invention is situated in the closet and contains, for example, lighter clothing. As the seasons change, when it is desired to replace the lighter clothing in the closet with winter clothing, the closet insert situated in the closet and which contains the lighter clothing, is removed from the closet and sealed shut, notably without removing the lighter clothing from the closet unit. A storage company delivers a second closet insert to the residence which is then situated in its entirety within the closet, and then filled with the resident's winter clothing. The second closet insert in effect then becomes the closet. The storage company transports the sealed first closet insert which was removed from the closet and which still contains the resident's summer clothing to an off-site storage location where it is stored until the summer clothing is needed again. When the weather becomes warmer, the first closet insert is transported from the offsite storage location back to the residence. The second closet insert containing winter clothing is removed from the closet and sealed without removing the winter clothing. The first closet insert containing the lighter clothing is then removably fit in its entirety back into the closet. The second closet insert containing the winter clothing is transported to the off-site storage location where it is stored until needed. It is seen that a portable storage unit constructed and used in this manner does not require packing, boxing, lifting or cleaning. Moreover, it is never necessary to re-hang or refold any of the garments. The fact that the closet inserts are structured and arranged to fit in their entirety within the closet insures that no living space within the apartment or house is required to accommodate the closet inserts. In this manner it is seen that according to this method the size of the closet is effectively doubled.

In accordance with another method of the invention in which a closet insert is used to maintain a set of clothing at a location remote from a residence, such as a hotel room or a dormitory, the closet insert is transported to the residence, the clothing is hung or otherwise situated in the closet insert, the closet insert is transported to the remote location, and the closet insert is situated in its entirety, with the clothes still hanging therein, in the closet enclosure.

Closet inserts in accordance with the invention are also useful in connection with new housing construction. In particular, closet enclosures in new buildouts need not be provided with closet hardware or shelving thereby saving the costs associated with such provisions. Rather, a closet insert in accordance with the invention including shelving, hanger bars, drawers and the like may be fitted in its entirety within the closet enclosure.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A closet insert for containing items of clothing and the like, comprising at least three insert modules including at least one intermediate insert module, a left insert module, a right insert module, and left and right end panels, wherein said at least one intermediate insert module comprises a back panel situated in a substantially vertical back plane, a top panel extending from said back panel and situated in a substantially horizontal top plane, a floor panel extending from said back panel and situated in a substantially horizontal floor plane;

said left insert module is situated laterally and to the left of said at least one intermediate insert module and includes a said back panel, a said top panel and a said floor panel; and said right insert module is situated laterally and to the right of said at least one intermediate insert module, and includes a said back panel, a said top panel and a said floor panel;

said back panels of said at least one intermediate, left and right insert modules situated in substantially coplanar vertical planes; said top panels of said at least one intermediate, left and right insert modules situated in substantially coplanar horizontal planes; and said floor panels of said at least one intermediate and said left and right insert modules situated in substantially coplanar horizontal planes; and said closet insert further comprising coupling devices mounted on mounting structures provided on each back panel, top panel, and floor panel of said left insert module, said right insert module, and said at least one intermediate insert module; wherein the coupling devices on each of the top panel, back panel, and floor panel of said at least one intermediate insert module matingly engage respective coupling devices on a laterally adjacent top panel, back panel, and floor panel of said right insert module or said left insert module for coupling said back panels top panels, and floor panels of said at least one intermediate, left and right insert modules to each other, said coupling devices thereby coupling said at least one intermediate, left and right insert modules to each other; and said left and right end panels are situated in spaced substantially vertical planes substantially perpendicular to said vertical and horizontal planes in which said back, top and floor panels of said at least one insert module are situated extending from at least one back panel of said at least one insert module wherein said left end panel extends from left edges of said back, top and floor panels of said left insert module and said right end panel extends from right edges of said back, top and floor panels of said right insert module wherein said coupling devices are interlocking cam lock members.

2. A closet insert as recited in claim 1 further including closet organizer hardware affixed to an inner surface of at least one of said panels of said at least three insert modules.

3. A closet insert as recited in claim 2 wherein said closet organizer hardware includes a hanger bar.

4. A closet insert as recited in claim 1 wherein each back, top and floor panel of each of said at least three closet insert modules are discrete members.

5. A closet insert as recited in claim 4 wherein each of said back, top and floor panels of each of said at least three closet insert modules are substantially rectangular in shape, and wherein each of said top and floor panels are connected to said each respective back panel at respective edge regions thereof.

6. A closet insert as recited in claim 1 further including wheels or casters provided on a bottom surface of a floor panel of at least one of said at least three closet insert modules.

7. A closet insert as recited in claim 1 wherein each of said mounting structures is situated at an edge region of a respective top, bottom and back panel.

8. A closet insert as recited in claim 1 further including a frame for receiving a safe situated in at least one of said at least three closet insert modules.

9. A closet insert as recited in claim 1 further including at least two parallel channel members connected to an outer surface at least one floor panel of at least one of said at least three closet insert modules for facilitating the lifting of the closet insert by a fork lift apparatus.

10. A closet insert as recited in claim 1 further including a door panel structured and arranged to connect to said top and floor panels of a respective closet insert module of said at least three closet insert modules.

11. A closet insert as recited in claim 10 wherein said door panel includes a lock for locking said door panel to said respective closet insert module of said at least three closet insert modules.

12. A closet insert as recited in claim 1 wherein the depth of each said top and floor panel does not exceed about 27 inches.

13. A closet insert as recited in claim 12 wherein the length of each said back panels is in the range of between about 1 foot to 3 feet.

14. A closet insert as recited in claim 12 wherein the height of each said back panels is in the range of between about 70 inches to 78 inches.

* * * * *